US010363454B2

(12) United States Patent
DiBenedetto et al.

(10) Patent No.: US 10,363,454 B2
(45) Date of Patent: Jul. 30, 2019

(54) PORTABLE FITNESS MONITORING METHODS

(71) Applicant: adidas AG, Herzogenaurach (DE)

(72) Inventors: Christian DiBenedetto, North Plains, OR (US); Mark Arthur Oleson, Portland, OR (US); Ian Michael Munson, Portland, OR (US)

(73) Assignee: adidas AG, Herzogenaurach (DE)

( * ) Notice: Subject to any disclaimer, the term of this patent is extended or adjusted under 35 U.S.C. 154(b) by 0 days.

(21) Appl. No.: 15/612,746

(22) Filed: Jun. 2, 2017

(65) Prior Publication Data

US 2017/0266495 A1 Sep. 21, 2017

Related U.S. Application Data

(63) Continuation of application No. 14/736,021, filed on Jun. 10, 2015, now Pat. No. 9,675,842, which is a (Continued)

(51) Int. Cl.
*A63B 24/00* (2006.01)
*G08B 3/10* (2006.01)
(Continued)

(52) U.S. Cl.
CPC ..... *A63B 24/0062* (2013.01); *A63B 71/0686* (2013.01); *G08B 3/1016* (2013.01);
(Continued)

(58) Field of Classification Search
None
See application file for complete search history.

(56) References Cited

U.S. PATENT DOCUMENTS 3,797,010 A * 3/1974 Adler ..... A61B 5/22 324/161
4,334,190 A * 6/1982 Sochaczevski ..... G01P 3/489 324/166
(Continued)

FOREIGN PATENT DOCUMENTS

EP 1 128 358 A1 8/2001
EP 1 251 441 A2 10/2002
(Continued)

OTHER PUBLICATIONS

Extended European Search Report for Application No. 10004894.1, Applicant: adidas AG, dated Nov. 18, 2010.
(Continued)

*Primary Examiner* — Joshua Lee
(74) *Attorney, Agent, or Firm* — Sterne, Kessler, Goldstein & Fox P.L.L.C.

(57) ABSTRACT

Portable fitness monitoring methods are disclosed. In an embodiment, a portable fitness monitoring method includes a method for providing audible output to a user during an athletic activity using a portable fitness monitoring device. The method includes the steps of receiving an audio feedback file package that includes a first audio feedback file, updating the audio feedback file package, and processing the updated audio feedback file package to provide audible output to the user through an audio output device during the athletic activity.

19 Claims, 15 Drawing Sheets

Related U.S. Application Data continuation of application No. 14/250,179, filed on Apr. 10, 2014, now Pat. No. 9,077,465, which is a continuation of application No. 14/045,471, filed on Oct. 3, 2013, now Pat. No. 8,715,139, which is a continuation of application No. 13/543,227, filed on Jul. 6, 2012, now Pat. No. 8,562,490, which is a continuation of application No. 13/252,626, filed on Oct. 4, 2011, now Pat. No. 8,241,184, which is a continuation of application No. 12/467,944, filed on May 18, 2009, now Pat. No. 8,033,959.

(51) Int. Cl.

| | |
|---|---|
| ***H04R 3/00*** | (2006.01) |
| ***A63B 71/06*** | (2006.01) |
| ***H04H 60/90*** | (2008.01) |

(52) U.S. Cl.

CPC ..... *H04H 60/90* (2013.01); *H04R 3/00* (2013.01); *A63B 2024/0068* (2013.01); *A63B 2024/0078* (2013.01); *A63B 2071/063* (2013.01); *A63B 2071/065* (2013.01); *A63B 2071/068* (2013.01); *A63B 2071/0625* (2013.01); *A63B 2071/0663* (2013.01); *A63B 2220/40* (2013.01); *A63B 2220/803* (2013.01); *A63B 2225/50* (2013.01); *A63B 2230/06* (2013.01)

(56) References Cited

U.S. PATENT DOCUMENTS 4,337,529 A * 6/1982 Morokawa ..... A61B 5/02438 331/113 R
4,571,680 A 2/1986 Wu
4,674,743 A 6/1987 Hirano
4,776,323 A 10/1988 Spector
4,788,983 A 12/1988 Brink et al.
5,137,501 A 8/1992 Mertesdorf
5,148,002 A 9/1992 Kuo et al.
5,215,468 A 6/1993 Lauffer et al.
5,267,942 A 12/1993 Saperston
5,314,389 A 5/1994 Dotan
5,454,770 A 10/1995 Stevens
5,492,514 A 2/1996 Daum
5,702,323 A 12/1997 Poulton
5,728,027 A 3/1998 Sinaiko
5,757,929 A 5/1998 Wang et al.
5,857,939 A 1/1999 Kaufman
5,891,042 A 4/1999 Sham et al.
5,976,083 A 11/1999 Richardson et al.
5,986,200 A 11/1999 Curtin
6,002,982 A 12/1999 Fry
6,013,007 A 1/2000 Root et al.
6,080,110 A 6/2000 Thorgersen
6,135,951 A 10/2000 Richardson et al.
6,148,262 A 11/2000 Fry
6,152,856 A 11/2000 Studor et al.
6,230,047 B1 5/2001 McHugh
6,251,048 B1 6/2001 Kaufman
6,345,197 B1 2/2002 Fabrizio
6,446,080 B1 9/2002 Van Ryzin et al.
6,452,856 B1 9/2002 Forbes et al.
6,463,385 B1 10/2002 Fry
6,513,532 B2 2/2003 Mault et al.
6,582,342 B2 6/2003 Kaufman
6,585,622 B1 7/2003 Shum et al.
6,607,493 B2 8/2003 Song
6,623,427 B2 9/2003 Mandigo
6,672,991 B2 1/2004 O'Malley
6,716,139 B1 4/2004 Hosseinzadeh-Dolkhani et al.
6,736,759 B1 5/2004 Stubbs et al.
6,746,247 B2 6/2004 Barton
6,753,882 B2 6/2004 Nakazawa et al.
6,808,473 B2 10/2004 Hisano et al.
6,823,036 B1 11/2004 Chen
6,837,827 B1 1/2005 Lee et al.
6,853,955 B1 2/2005 Burrell et al.
6,882,955 B1 4/2005 Ohlenbusch et al.
7,003,122 B2 2/2006 Chen
7,062,225 B2 6/2006 White
7,085,678 B1 8/2006 Burrell et al.
7,229,385 B2 6/2007 Freeman et al.
7,251,454 B2 7/2007 White
7,254,368 B1 8/2007 Okada et al.
7,254,516 B2 8/2007 Case, Jr. et al.
7,292,867 B2 11/2007 Werner et al.
7,308,818 B2 12/2007 Considine et al.
7,398,151 B1 7/2008 Burrell et al.
7,480,512 B2 1/2009 Graham et al.
7,518,054 B2 4/2009 McKinney et al.
7,519,327 B2 4/2009 White
7,559,879 B2 7/2009 Anderson et al.
7,603,255 B2 10/2009 Case, Jr. et al.
7,648,463 B1 1/2010 Elhag et al.
7,658,695 B1 2/2010 Amsbury et al.
7,670,263 B2 3/2010 Ellis et al.
7,766,794 B2 8/2010 Oliver et al.
7,771,320 B2 8/2010 Riley et al.
7,973,231 B2 7/2011 Bowen
8,001,472 B2 8/2011 Gilley et al.
8,033,959 B2 10/2011 Oleson et al.
8,060,229 B2 11/2011 Gupta et al.
8,105,208 B2 1/2012 Oleson et al.
8,200,323 B2 6/2012 DiBenedetto et al.
8,241,184 B2 8/2012 DiBenedetto et al.
8,562,490 B2 10/2013 DiBenedetto et al.
8,715,139 B2 5/2014 DiBenedetto et al.
8,727,947 B2 5/2014 Tag Iabue
8,777,621 B2 7/2014 Holljes
8,933,313 B2 * 1/2015 Turner ..... G10H 1/40 84/612
2001/0003542 A1 6/2001 Kita
2003/0139254 A1 7/2003 Chang
2003/0171189 A1 9/2003 Kaufman
2003/0224337 A1 12/2003 Shum et al.
2004/0046692 A1 3/2004 Robson et al.
2004/0102931 A1 5/2004 Ellis et al.
2004/0116784 A1 6/2004 Gavish
2004/0199056 A1 10/2004 Husemann et al.
2005/0049113 A1 3/2005 Yueh et al.
2005/0124463 A1 6/2005 Yeo et al.
2005/0126370 A1 * 6/2005 Takai ..... A63B 24/0003 84/636
2005/0195094 A1 9/2005 White
2005/0197063 A1 9/2005 White
2005/0266961 A1 12/2005 Shum et al.
2006/0136173 A1 6/2006 Case, Jr. et al.
2006/0169125 A1 8/2006 Ashkenazi et al.
2006/0189360 A1 8/2006 White
2006/0253210 A1 11/2006 Rosenberg
2007/0006489 A1 1/2007 Case, Jr. et al.
2007/0011919 A1 1/2007 Case, Jr.
2007/0021269 A1 1/2007 Shum
2007/0033069 A1 2/2007 Rao et al.
2007/0066451 A1 3/2007 Gruben et al.
2007/0260421 A1 11/2007 Berner, Jr. et al.
2008/0002528 A1 1/2008 Andren et al.
2009/0233770 A1 9/2009 Vincent et al.
2010/0125218 A1 5/2010 Haartsen et al.
2010/0279822 A1 11/2010 Ford
2012/0274469 A1 11/2012 Oleson et al.

FOREIGN PATENT DOCUMENTS

JP 2007-34658 A 2/2007
JP 2007-43356 A 2/2007
JP 2007-53510 A 3/2007
JP 2007-193907 A 8/2007
WO WO 02/067449 A2 8/2002

(56) References Cited

FOREIGN PATENT DOCUMENTS

| | | |
|---|---|---|
| WO | WO 2008/101168 A2 | 8/2008 |
| WO | WO 2009/033034 A1 | 3/2009 |

OTHER PUBLICATIONS

Richtel, Matt, "Surfing for Music," Popular Science, 7 pages, Sep. 1999: pp. 70-74.
RIO PMP300 User's Guide, Diamond Multimedia Systems, Inc., San Jose, CA, USA, 1998: 28 pages.
Tucker et al., "A Microprocessor-Based Fitness Feedback for Runners," 1991 IEEE Case Studies Monitor With Analog Voice in Medical Instrument Design, 1991: pp. 163-170.
Office Action issued in Japanese Appl. No. 2012-182226, dated Dec. 2, 2014.

* cited by examiner

| ZONE | COLOR | % OF MAX HR |
|---|---|---|
| ENERGY | BLUE | 65–75% |
| ENDURANCE | GREEN | 75–85% |
| STRENGTH | YELLOW | 85–90% |
| POWER | RED | 90–95% |

EXAMPLE NARRATION TABLE

| TRIGGER POINT | ACTION | EXAMPLE FEEDBACK | | |
|---|---|---|---|---|
| | | EXAMPLE 1 | EXAMPLE 2 | EXAMPLE 3 |
| START BUTTON | START WORKOUT | BEGIN WORKOUT<br>LET'S GET STARTED | BEGIN WORKOUT<br>LET'S GET STARTED | BEGIN WORKOUT<br>LET'S GET STARTED |
| | SPEED UP TO STRENGTH ZONE | ACCELERATE TO STRENGTH ZONE<br>SPEED UP TO STRENGTH ZONE | ACCELERATE TO YELLOW ZONE<br>SPEED UP TO YELLOW ZONE | ACCELERATE TO __BPM<br>SPEED UP TO __BPM |
| | ENTERING STRENGTH ZONE | ENTERING STRENGTH ZONE | ENTERING YELLOW ZONE | APPROACHING __BPM |
| | ZONE ACHIEVED | STRENGTH ZONE ACHIEVED<br>STRENGTH ZONE | YELLOW ZONE ACHIEVED<br>YELLOW ZONE | __BPM ACHIEVED<br>__BPM |
| HEART RATE LOW<br><br>5 BEATS BELOW TARGET ZONE<br>REPEAT EVERY 3 MINUTES IF STILL NOT IN ZONE<br>REPEAT IF WAS IN ZONE AND WENT BELOW AGAIN | INCREASE HEART RATE | ACCELERATE TO STRENGTH ZONE<br>SPEED UP TO STRENGTH ZONE | ACCELERATE TO YELLOW ZONE<br>SPEED UP TO YELLOW ZONE | ACCELERATE TO __BPM<br>SPEED UP TO __BPM |
| HEART RATE HIGH<br><br>5 BEATS BELOW TARGET ZONE<br>REPEAT EVERY 3 MINUTES IF STILL NOT IN ZONE<br>REPEAT IF WAS IN ZONE AND WENT ABOVE AGAIN | DECREASE HEART RATE | EASE BACK TO STRENGTH ZONE<br>SLOW DOWN TO STRENGTH ZONE | SLOW DOWN TO YELLOW ZONE<br>EASE BACK TO YELLOW ZONE | SLOW DOWN TO __BPM |

FIG. 9A

| | | | | |
|---|---|---|---|---|
| HEART RATE MIDPOINT OF RANGE REACHED | MAINTAIN HEART RATE | MAINTAIN STRENGTH ZONE<br>STRENGTH ZONE<br>STRENGTH ZONE ACHIEVED<br>MAINTAIN STRENGTH ZONE FOR __<br>MAINTAIN SPEED FOR __ | YELLOW ZONE ACHIEVED<br>YELLOW ZONE<br>MAINTAIN YELLOW ZONE FOR __ | __BPM ACHIEVED<br>__BPM |
| PERCENT OF WORKOUT COMPLETED | UPDATE USER | | | |
| | 25% | ONE QUARTER COMPLETE<br>__MINUTES LEFT TO GO<br>__MINUTES OF WORKOUT LEFT | ONE QUARTER COMPLETE<br>__MINUTES LEFT TO GO<br>__MINUTES OF WORKOUT LEFT | ONE QUARTER COMPLETE<br>__MINUTES LEFT TO GO<br>__MINUTES OF WORKOUT LEFT |
| | 50% | HALFWAY DONE WORKOUT<br>__MINUTES LEFT TO GO<br>__MINUTES OF WORKOUT LEFT | HALFWAY DONE WORKOUT<br>__MINUTES LEFT TO GO<br>__MINUTES OF WORKOUT LEFT | HALFWAY DONE WORKOUT<br>__MINUTES LEFT TO GO<br>__MINUTES OF WORKOUT LEFT |
| | 75% | THREE QUARTERS COMPLETE<br>__MINUTES LEFT TO GO<br>__MINUTES OF WORKOUT LEFT | THREE QUARTERS COMPLETE<br>__MINUTES LEFT TO GO<br>__MINUTES OF WORKOUT LEFT | THREE QUARTERS COMPLETE<br>__MINUTES LEFT TO GO<br>__MINUTES OF WORKOUT LEFT |
| | 90% | __MINUTES LEFT TO GO<br>__MINUTES OF WORKOUT LEFT | __MINUTES LEFT TO GO<br>__MINUTES OF WORKOUT LEFT | __MINUTES LEFT TO GO<br>__MINUTES OF WORKOUT LEFT |
| FINISHED WORKOUT | FINISHED | WORKOUT COMPLETE | WORKOUT COMPLETE | WORKOUT COMPLETE |
| | CONGRATULATIONS | NICE WORK<br>GOOD JOB | NICE WORK<br>GOOD JOB | NICE WORK<br>GOOD JOB |
| | COOLDOWN | ENTERING COOL DOWN<br>PLEASE WALK FOR __<br>TIME TO COOL DOWN | ENTERING COOL DOWN<br>PLEASE WALK FOR __<br>TIME TO COOL DOWN | ENTERING COOL DOWN<br>PLEASE WALK FOR __<br>TIME TO COOL DOWN |

FIG. 9B

PORTABLE FITNESS MONITORING METHODS

CROSS-REFERENCE TO RELATED APPLICATIONS

This application is a continuation of U.S. patent application Ser. No. 14/736,021, filed Jun. 10, 2015, which is a continuation of U.S. patent application Ser. No. 14/250,179, filed Apr. 10, 2014, now U.S. Pat. No. 9,077,465, which is a continuation of U.S. patent application Ser. No. 14/045,471, filed Oct. 3, 2013, now U.S. Pat. No. 8,715,139, which is a continuation of U.S. patent application Ser. No. 13/543,227, filed Jul. 6, 2012, now U.S. Pat. No. 8,562,490, which is a continuation of U.S. patent application Ser. No. 13/252,626, filed Oct. 4, 2011, now U.S. Pat. No. 8,241,184, which is a continuation of U.S. patent application Ser. No. 12/467,944, filed May 18, 2009, now U.S. Pat. No. 8,033,959. This application is also related to commonly owned U.S. patent application Ser. No. 12/467,948, filed May 18, 2009, now U.S. Pat. No. 8,105,208, and commonly owned U.S. patent application Ser. No. 12/468,025, filed May 18, 2009, now U.S. Pat. No. 8,200,323. Each of the above-mentioned references is incorporated herein by reference in its entirety.

FIELD OF THE INVENTION

The present invention generally relates to fitness monitoring methods. More particularly, the present invention relates to fitness monitoring methods for providing performance feedback to a user.

BACKGROUND OF THE INVENTION

Exercise is important to maintaining a healthy lifestyle and individual well-being. Accordingly, many individuals want to participate in an exercise program. The most successful exercise programs may be ones tailored to a fitness level of an individual and aimed at assisting the individual to achieve one or more specific fitness or exercise goals. Information about the individual's progress toward achieving their goals may be collected using sensors for measuring various physical and/or physiological parameters associated with the individual's physical activity.

Sports trainers, as well as other exercise and fitness professionals, are available to assist individuals in developing exercise programs appropriate for their individual fitness levels and their specific fitness or exercise goals. Hiring such professionals, however, can be expensive. Furthermore, the busy schedules of many individuals make it difficult for these individuals to set aside time to meet with an exercise and fitness professional on a routine basis. Thus, many individuals forego using the services of exercise and fitness professionals, and they never achieve the benefits that can be obtained from an exercise program tailored, for example, to one's fitness level.

Technology has resulted in the development of portable fitness monitoring devices capable of providing performance feedback to the individual during a physical activity. Some of these devices are also be capable of providing music to the individual during the physical activity.

What is needed are new portable fitness monitoring systems having improved functionalities, such as the ability to utilize a portable fitness monitoring device with performance data logging, performance feedback, and/or music capabilities, thus offering the individual a variety of options while exercising.

BRIEF SUMMARY OF THE INVENTION

Embodiments of the present invention relate to a method for providing audible output to a user during an athletic activity using a portable fitness monitoring device that includes the steps of receiving an audio feedback file package including a first audio feedback file, updating the audio feedback file package, and processing the updated audio feedback file package to provide audible output to the user through an audio output device during the athletic activity.

Embodiments of the present invention also relate to a method for providing audio feedback output to a user during an athletic activity using a portable fitness monitoring device that includes the steps of receiving a first audio feedback file package, receiving a second audio feedback file package, and selecting the second audio feedback file package and processing the second audio feedback file package to provide audible output to the user through an audio output device during the athletic activity, wherein the processing includes generating an audio feedback phrase.

Further embodiments, features, and advantages of the present invention, as well as the structure and operation of the various embodiments of the present invention, are described in detail below with reference to the accompanying drawings.

BRIEF DESCRIPTION OF THE DRAWINGS/FIGURES

The accompanying drawings, which are incorporated herein and form a part of the specification, illustrate the present invention by way of example, and not by way of limitation, and, together with the description, further serve to explain the principles of the invention and to enable a person skilled in the pertinent art to make and use the invention.

FIGS. 9A-B is a table that illustrates exemplary audio performance feedback according to an embodiment of the present invention.

Figure 10:
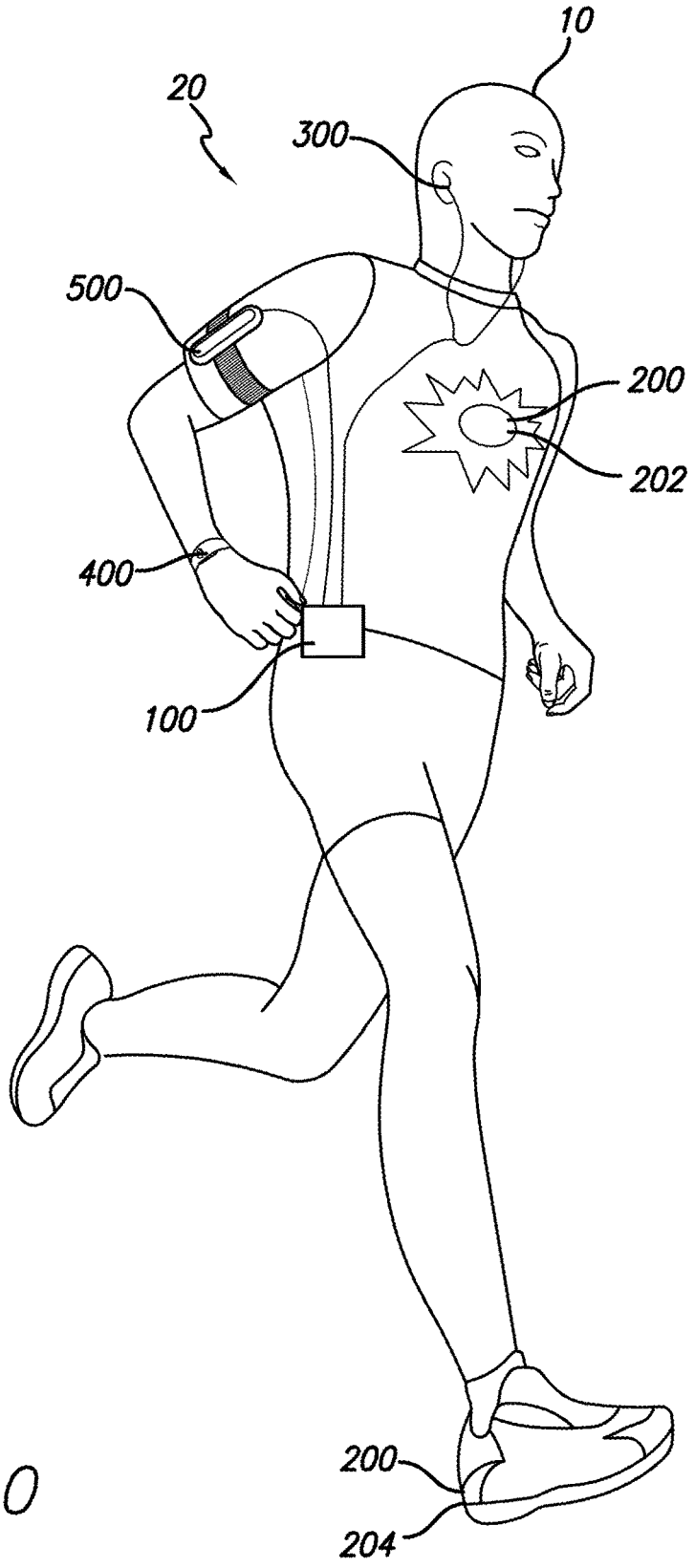

FIG. 10 is an illustration of an athlete using a portable fitness monitoring system according to an embodiment of the present invention.

Figure 11:
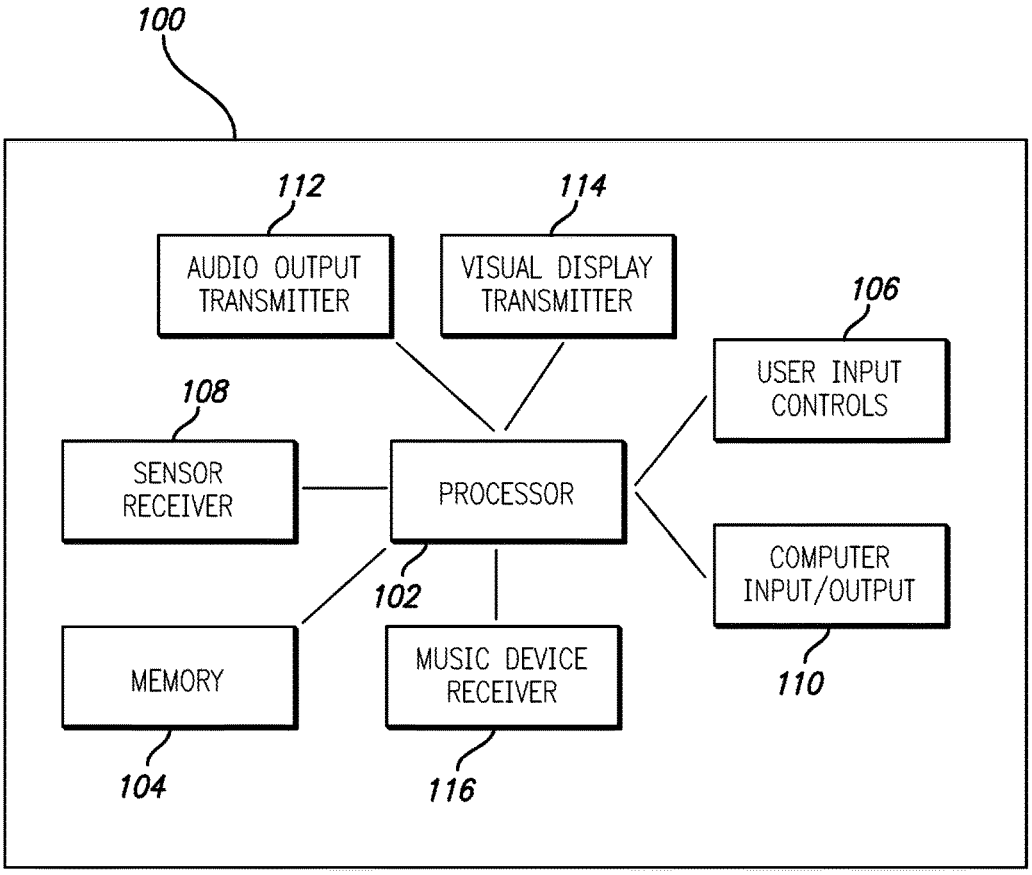

FIG. 11 is an illustration of a block diagram of components of a portable fitness monitoring device according to an embodiment of the present invention.

Figure 12:
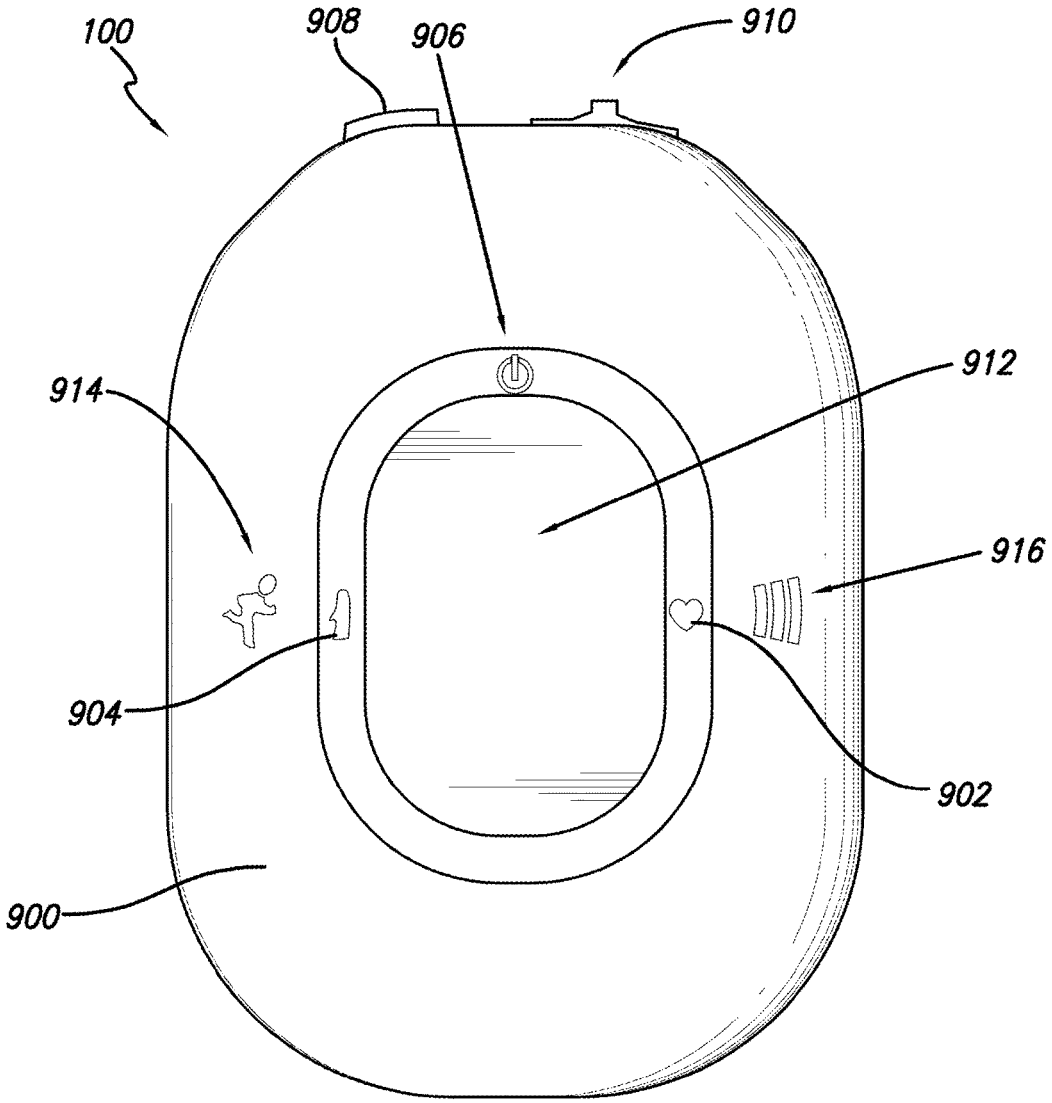

FIG. 12 is a front view of a portable fitness monitoring device according to an embodiment of the present invention.

Figure 13:
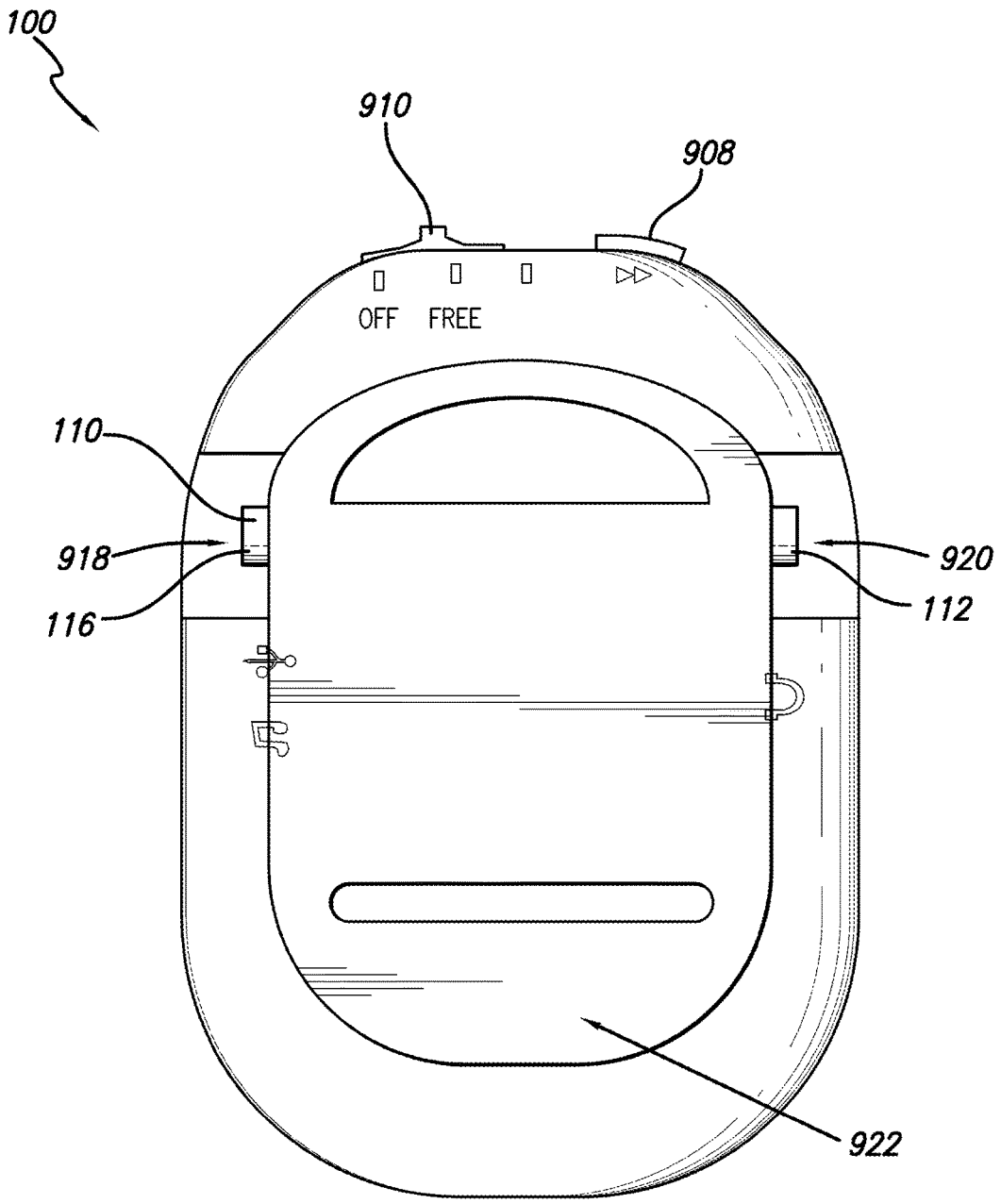

FIG. 13 is a rear view of a portable fitness monitoring device according to an embodiment of the present invention.

Figure 14:
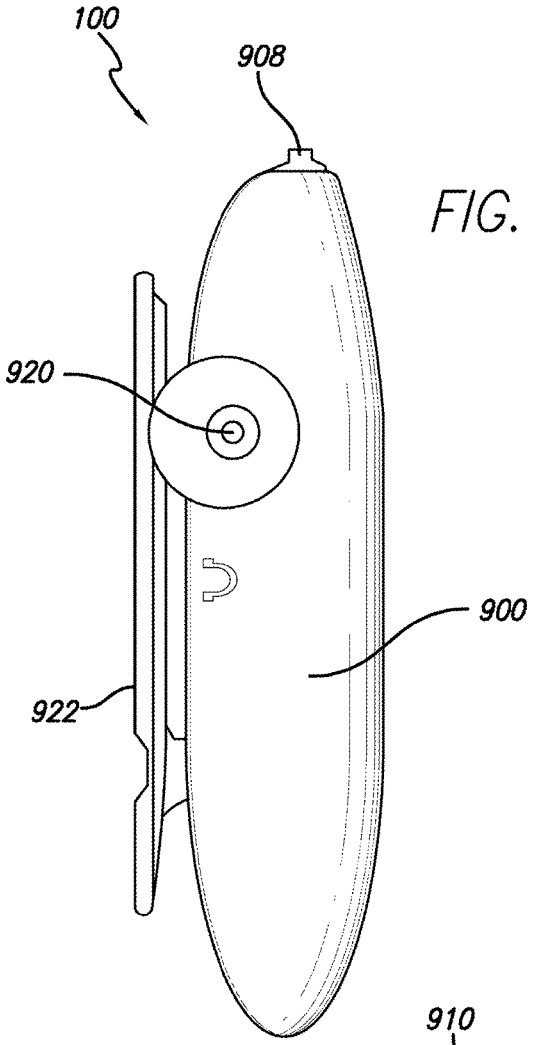

FIG. 14 is a side view of a portable fitness monitoring device according to an embodiment of the present invention.

Figure 15:
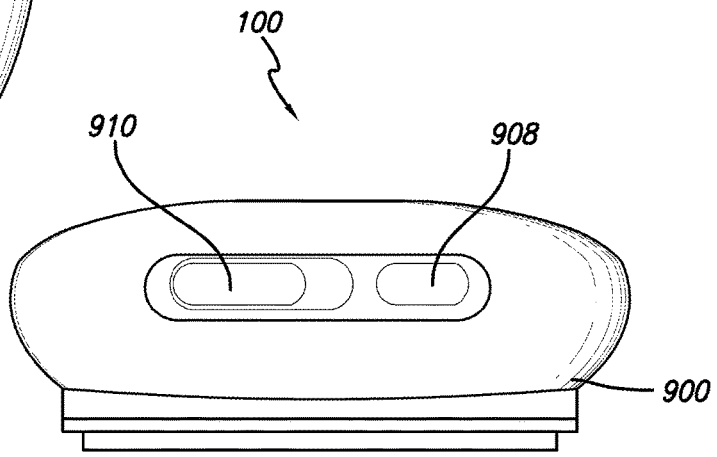

FIG. 15 is a top view of a portable fitness monitoring device according to an embodiment of the present invention.

Figure 16:
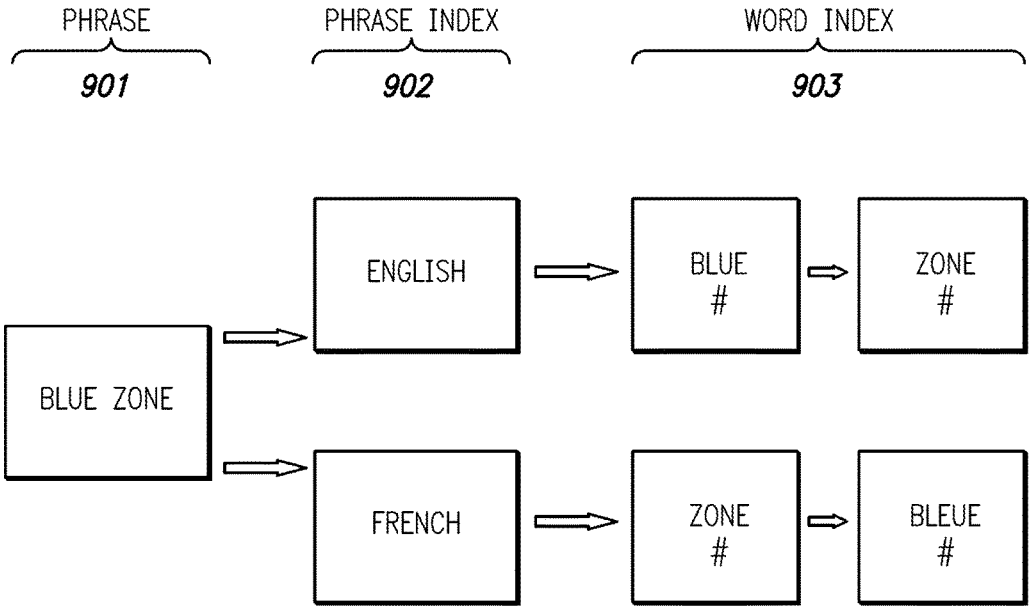

FIG. 16 is a diagram of a language file package according to an embodiment of the present invention.

DETAILED DESCRIPTION OF THE INVENTION

The present invention will now be described in detail with reference to embodiments thereof as illustrated in the accompanying drawings. References to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

Figure 1:
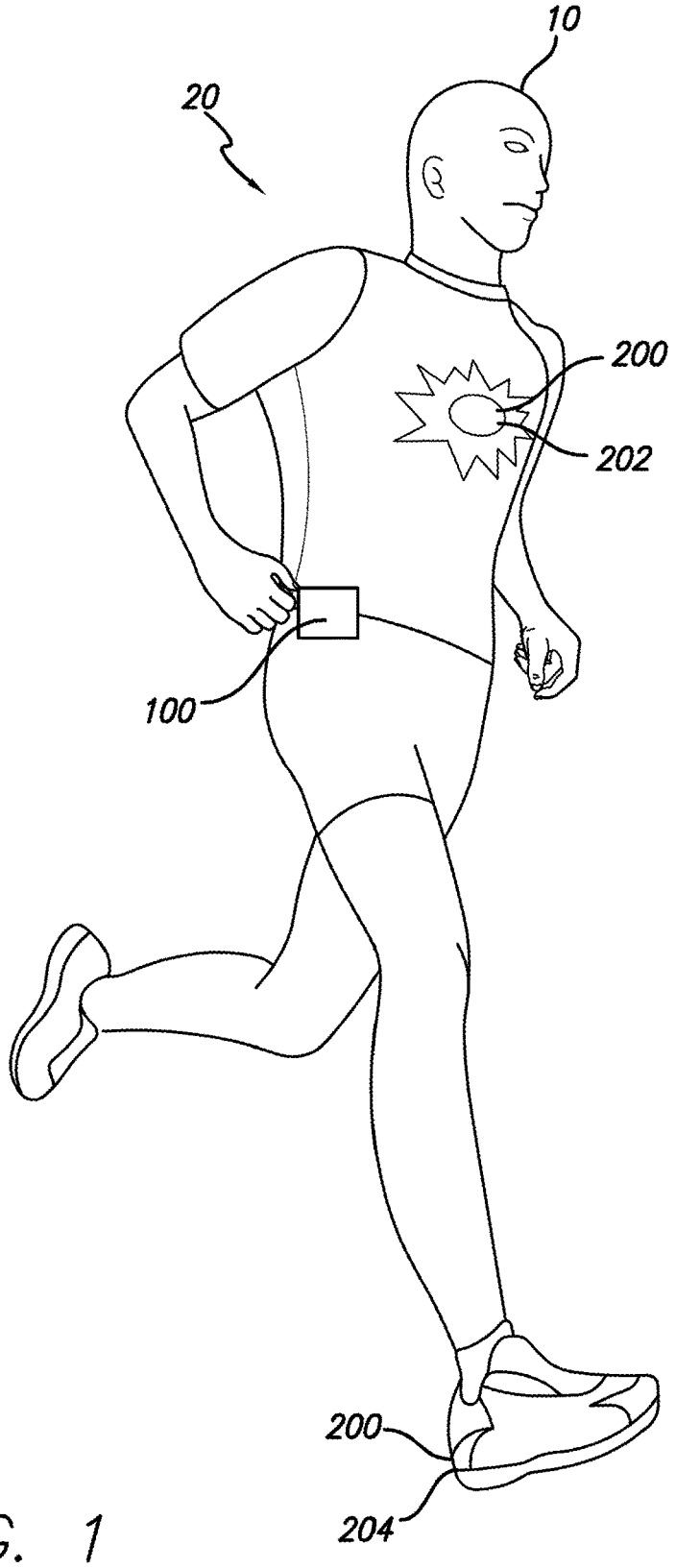
FIG. 1 is an illustration of an athlete using a portable fitness monitoring system according to an embodiment of the present invention.

FIG. 1 is a diagram of an athlete 10 using a portable fitness monitoring system 20 for providing performance feedback to the athlete according to one embodiment of the present invention. As depicted in FIG. 1, the portable fitness monitoring system 20 includes a portable fitness monitoring device 100 in communication with one or more portable sensors 200. The portable fitness monitoring system 20 may also provide performance data logging, and/or entertainment (e.g., music) to the athlete 10.

The athlete 10 may use the portable fitness monitoring system 20 in conjunction with a variety of physical activities such as, for example, running, walking, biking, skating, swimming, skiing, performing aerobic exercises, weight lifting, and/or any other suitable individual or team sport. Accordingly, terms such as, for example, "athlete," "runner," "exercising individual," and "user" may be referred to herein interchangeably.

The portable fitness monitoring device 100 may be worn, carried, or otherwise supported by the athlete 10 during the physical activity. In the embodiment of FIG. 1, the portable fitness monitoring device 100 is clipped to the athlete's 10 waistband at the athlete's 10 hip. In other embodiments, the portable fitness monitoring device 100 may be secured elsewhere on the athlete's 10 body such as, for example, on the athlete's 10 forearm, chest, hip, or foot, or on an article of clothing worn by the athlete 10, such as, for example, a shirt, shorts, a shoe, sunglasses, or a hat.

The portable fitness monitoring device 100 and the sensors 200 may be in wired or wireless communication with one another. The monitoring device 100 and the sensors 200 may communicate over a network using one or more of the following protocols: ANT, ANT+ by Dynastream Innovations, Bluetooth Low Energy Technology, or BlueRobin. Other known communication protocols suitable for a fitness monitoring system may be used. In addition, in some embodiments the monitoring system 100 may be adapted to be used outside the fitness application (e.g., in a medical device application). Accordingly, known communication protocols suitable for medical device applications may also be used.

The sensors 200 may measure one or more performance parameters associated with the athlete's 10 physical activity, and communicate performance parameter data to the portable fitness monitoring device 100. The term "performance parameters" may include physical parameters and/or physiological parameters associated with the athlete's 10 physical activity. Physical parameters measured may include, but are not limited to, time, distance, speed, pace, pedal count, wheel rotation count, stride count, stride length, airtime, stride rate, altitude, strain, and impact force. Physiological parameters measured may include, but are not limited to, heart rate, respiration rate, blood oxygen level, blood flow, hydration level, calories burned, or body temperature. In one embodiment of the present invention, as shown in FIG. 1, a heart rate sensor 202 is coupled to the athlete's 10 chest, while an accelerometer 204 is coupled to the athlete's 10 shoe. Other sensors 200, including, but not limited to, a pedometer, a pulsimeter, a thermometer, an altimeter, a pressure sensor, a strain gage, a bicycle power meter, a bicycle crank or wheel position sensor, a magnetic sensor, a gyroscope, a resistance sensor, a force sensor, or other sensors 200 for detecting a user performance parameter are considered to be within the scope and spirit of the present invention.

In one embodiment of the present invention, the portable fitness monitoring device 100 may be a dedicated portable fitness monitoring device 100. The term "dedicated portable fitness monitoring device" indicates that the device 100 is not capable of serving another purpose outside of the portable fitness monitoring system 20 of the present invention. For example, a mobile phone, a personal digital assistant, or a digital music file player (e.g. an MP3 player) may not be considered to be "dedicated portable fitness monitoring devices" as the term is used herein. In this manner, the portable fitness monitoring device 100 may in some embodiments provide a simpler and/or more efficient device.

In other embodiments, while the portable fitness monitoring device 100 may not be a dedicated portable fitness monitoring device 100, as defined herein, it still may not perform certain activities. For example, the portable fitness monitoring device 100 itself may not, for example, store digital music files (e.g. MP3s), make or receive telephone calls, send or receive email and/or text messages, visually display the current time of day, or visually display performance parameter information via an integrally formed display. A device 100 lacking one or more of these features may be desirable because of its reduced size, weight, complexity, and cost.

Alternatively, the portable fitness monitoring device 100 may be capable of performing some or all of these functions. While the portable fitness monitoring device 100 may not be a dedicated portable fitness monitoring device 100, as defined herein, and while it still may not perform certain activities, as described above, it may, for example, store certain types of MP3s or other audio files, but not others. In one embodiment, the portable fitness monitoring device 100 may store audio performance feedback files 304, as described in further detail below, but may not store music files 508, also described in further detail below. Storing only audio performance feedback files 304 but not music files 508 may be desirable because of the reduced size, weight, complexity, and/or cost of a device 100 with less memory capacity.

In another embodiment, the portable fitness monitoring device 100 may store both audio performance feedback files 304 and music files 508.

Figure 2:
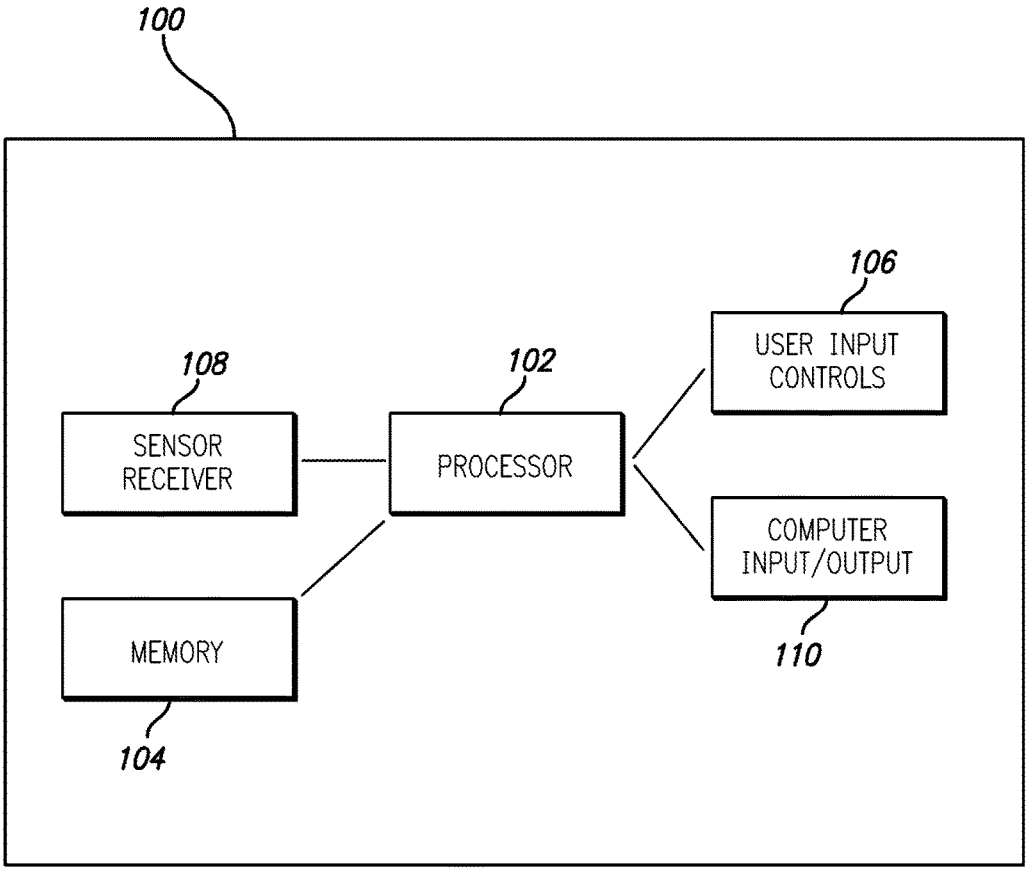
FIG. 2 is a block diagram of components of a portable fitness monitoring device according to an embodiment of the present invention.

With reference to FIG. 2, in one embodiment the portable fitness monitoring device 100 may include a processor 102, a memory 104, user input controls 106, a sensor receiver 108, and a computer input/output 110 operatively connected to carry out the functionality of the device.

The processor 102 is adapted to implement application programs stored in the memory 104. The processor 102 may also be capable of implementing analog or digital signal processing algorithms, such as, for example, those disclosed in U.S. Patent Application Pub. No. 2009/0047645, titled "Sports electronic training system, and applications thereof," the disclosure of which is incorporated herein in its entirety by reference thereto. The processor 102 is operatively connected to the memory 104, the user input controls 106, the sensor receiver 108, and the computer input/output 110. In one embodiment, the processor 102 may be model number CY8C20666 made by Cypress Microsystems of Lynwood, Wash.

The memory 104 is adapted to store application program instructions and to save recorded performance parameter data. In an embodiment, the memory 104 may store application programs used to implement aspects of the functionality of the portable fitness monitoring system 20 described herein. The memory 104 may include both read only memory and random access memory.

The user input controls 106 may be used by the athlete 10 to interact with the portable fitness monitoring device 100. In an embodiment, user input controls 106 may include one or more input buttons, switches, or keys. The function of each of these buttons, switches, or keys may be determined based on an operating mode of the portable fitness monitoring device 100. In one embodiment, the user input controls 106 may include a touch pad or scroll pad and/or touch screen buttons. In another embodiment, the user input controls 106 may include capacitance switches. In a further embodiment, the user input controls 106 may be voice-activated controls.

The sensor receiver 108 may be any device capable of wired or wireless communication with a sensor 200 of the portable fitness monitoring system 20. In one embodiment, the sensor receiver 108 is a low-power receiver used to wirelessly communicate with the portable sensor 200. The sensor receiver 108 may include an antenna, and may operate in an unlicensed frequency band such as 2.4 GHz. In an embodiment, the sensor receiver 108 may be a transceiver capable of bidirectional communication with the sensor 200.

The computer input/output 110 may be any input/output device or transceiver capable of wired or wireless communication with a personal computer 600 and/or a server 602, as described in further detail below.

In the embodiment of FIGS. 1 and 2, the portable fitness monitoring device 100 may not include an integrally formed visual display or an integrally formed audio output device for providing performance feedback. This embodiment also may not include transmitters or transceivers for wired or wireless transmission of visual or audio data to portable visual display devices or portable audio output devices supported by the body of the athlete 10. Accordingly, the portable fitness monitoring device 100 of FIGS. 1 and 2 may primarily function as a passive data logger. The term "passive data logger" as used herein indicates that the device 100 may receive and record performance parameter data, and may transmit performance parameter data to a personal computer 600 and/or a server 602, as described in further detail below, but that the device 100 may not provide performance parameter feedback to the athlete 10 in real-time during the physical activity.

Figure 3:
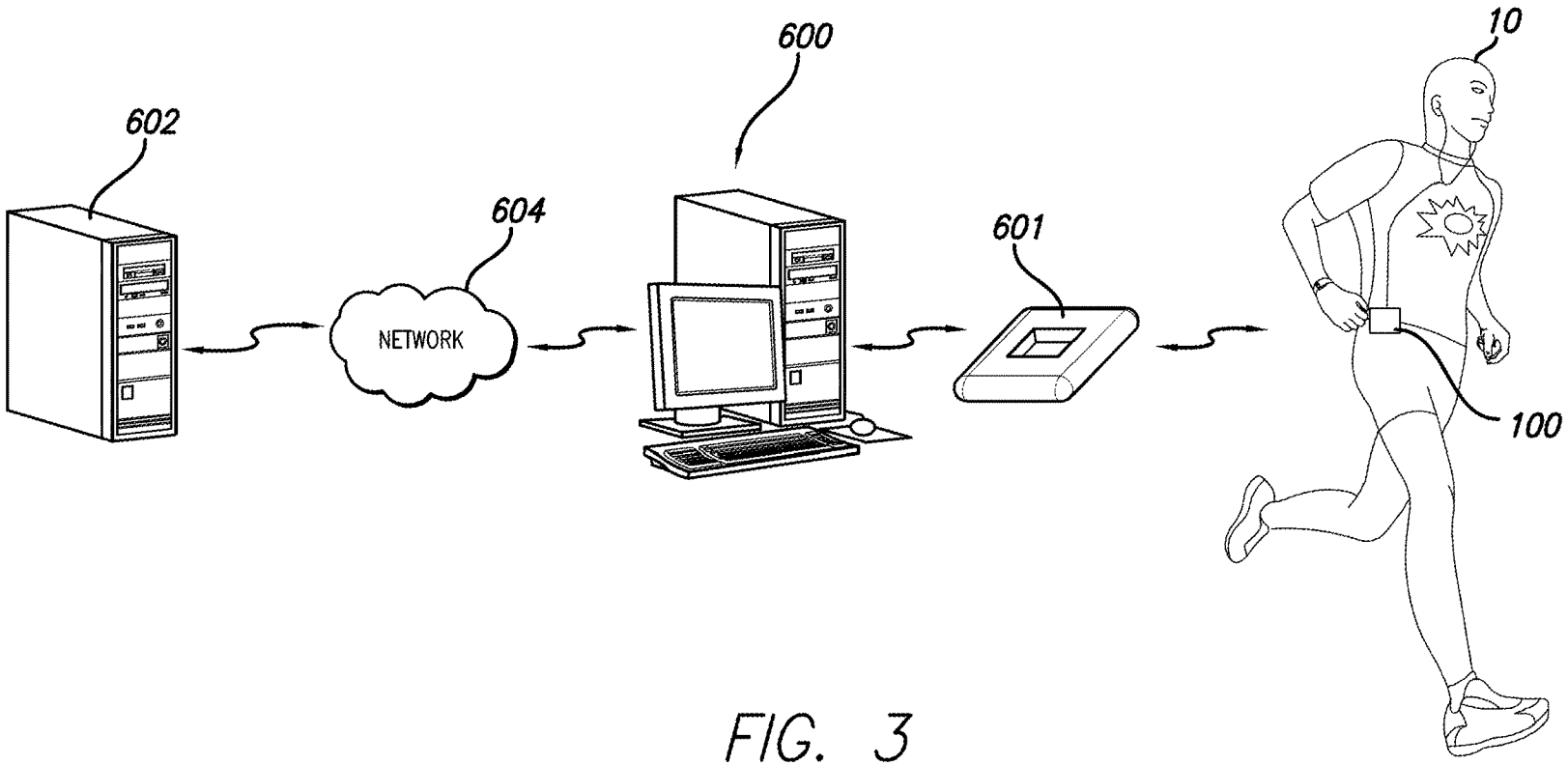
FIG. 3 is an illustration of a portable fitness monitoring device interacting with a computer and/or a server according to an embodiment of the present invention.

In one embodiment, as shown in FIG. 3, the portable fitness monitoring device 100 may communicate with a personal computer 600 using wired or wireless communications. Wired communication between the portable fitness monitoring device 100 and the personal computer 600 may be achieved, for example, by placing the portable fitness monitoring device 100 in a docking unit 601 that is attached to the personal computer 600 using a communications wire plugged into a communications port of the personal computer 600. In another embodiment, wired communication between the portable fitness monitoring device 100 and the personal computer 600 may be achieved, for example, by connecting a cable between the device 100 and the computer 600. The computer input/output 110 of the device 100 and a communications port of the computer 600 may include USB ports. The cable connecting the device 100 and the computer 600 may be a USB cable with suitable USB plugs including, but not limited to, USB-A or USB-B regular, mini, or micro plugs.

Wireless communication between the portable fitness monitoring device 100 and the personal computer 600 may be achieved, for example, by way of a wireless wide area network (WWAN—such as, for example, the Internet), a wireless local area network (WLAN), or a wireless personal area network (WPAN) (collectively, wireless area networks or WANs). As is well known to those skilled in the art, there are a number of known standard and proprietary protocols that are suitable for implementing WANs (e.g. TCP/IP, IEEE 802.16, and Bluetooth). Accordingly, embodiments of the present invention are not limited to using any particular protocol to communicate between the portable fitness monitoring device 100 and the various elements of the fitness monitoring system 20 of the present invention.

In one embodiment, the device 100 may communicate with a WWAN communications system such as that employed by mobile telephones. For example, a WWAN communication system may include a plurality of geographically distributed communication towers and base station systems. Communication towers may include one or more antennae supporting long range two-way radio frequency communication wireless devices, such as portable fitness monitoring device 100. The radio frequency communication between antennae and the device 100 may utilize radio frequency signals conforming to any known or future developed wireless protocol, for example, CDMA, GSM, EDGE, 3G, IEEE 802.x (e.g., IEEE 802.16 (WiMAX)), etc. The information transmitted over-the-air by the base station systems and the cellular communication towers to the portable fitness monitoring device 100 may be further transmitted to or received from one or more additional circuit-switched or packet-switched communication networks, including, for example, the Internet.

As shown in FIG. 3, communication may also occur between the personal computer 600 and a server 602 via a network 604. In an embodiment, the network 604 is the Internet. The Internet is a worldwide collection of servers, routers, switches and transmission lines that employ the Internet Protocol (TCP/IP) to communicate data. The network 604 may also be employed for communication between any two or more of the portable fitness monitoring device 100, the personal computer 600, the server 602, and the docking unit 601. In an embodiment of the present invention, information is directly communicated between the portable fitness monitoring device 100 and the server 602 via the network 604, thus bypassing the personal computer 600 and the docking unit 601.

With respect to the embodiment of the present invention illustrated in FIGS. 1 and 2, a variety of information may be communicated between any of the personal fitness monitoring device 100, the personal computer 600, the network 604, the server 602, and the docking unit 601. Such information may include, for example, performance parameter data, device settings (including portable fitness monitoring device 100 and sensor 200 settings), software, and firmware.

Communication among the various elements of the present invention may occur after the physical activity has been completed or in real-time during the physical activity. In addition, the interaction between, for example, the portable fitness monitoring device 100 and the personal computer 600, and the interaction between the personal computer 600 and the server 602 may occur at different times.

In one embodiment of the system 20 of the present invention, an athlete 10 may use the monitoring device 100 of FIGS. 1 and 2 as follows. Before the athlete 10 begins a physical activity, the athlete 10 may secure the accelerometer 204 to his article of footwear and the heart rate sensor 202 to his chest. The athlete 10 may activate the portable fitness monitoring device 100 by using one or more user input controls 106. At this time, the portable fitness monitoring device 100 may identify and begin to communicate with the sensors 200 via a WPAN to initiate the transmission of heart rate and acceleration data from the sensors 200 to the portable fitness monitoring device 100. The portable fitness monitoring device 100 may be worn, carried, or otherwise supported by the athlete 10.

As the athlete 10 engages in physical activity, the sensor receiver 108 receives performance parameter data from the heart rate sensor 202 and accelerometer 204.

The heart rate sensor 202 and accelerometer 204 may wirelessly transmit one radio pulse for each detected event (e.g. a heart beat or a foot strike). Alternatively, the sensors 200 may wirelessly transmit uniquely coded data signals that prevent the user's 10 portable fitness monitoring device 100 from receiving data signals from other nearby sensors 200 that are not associated with the user 10. Transmission between the sensors 200 and the portable fitness monitoring device 100 may occur in real-time, at predetermined regular intervals, upon the occurrence of specified events, after the user 10 completes their physical activity, or at any other suitable time.

The heart rate sensor 202 and accelerometer 204 operate according to principles and techniques that are well known to those of skill in the art. The heart rate sensor 202 may be, for example, a sensor 200 such as those provided by Garmin Ltd. of Olathe, Kans. The accelerometer 204 may be, for example, an accelerometer-based speed sensor such as the Forerunner305 provided by Garmin Ltd. of Olathe, Kans. that may or may not incorporate an internal clock/timer. Other sensors 200, such as those provided by, for example, Analog Devices, Inc. of Norwood, Mass. or Kionix, Inc. of Ithaca, N.Y. may be used. In an embodiment, the accelerometer may be replaced by, for example, a pedometer, a motion sensor, a positioning sensor, or a GPS-enabled speed sensor.

While the accompanying description is primarily directed towards embodiments wherein the sensor 200 is a heart rate sensor 202 or an accelerometer 204, those of skilled in the art will readily recognize that a variety of performance parameter sensors 200 may be used.

As the performance parameter data is transmitted to the portable fitness monitoring device 100, it may be stored in the memory 104 or transmitted to the server 602. When performance parameter data is continuously transmitted to the portable fitness monitoring device 100 in real-time, it may also be transmitted to the server 602 in real-time. The performance parameter data may be processed by the processor 102 prior to storage or transmission. In an embodiment, performance parameter data is pre-processed by the sensors 200 themselves.

After the athlete 10 finishes the physical activity, the athlete 10 may deactivate the portable fitness monitoring device 100 by using a user input control 106. Alternatively, in one embodiment of the present invention, the portable fitness monitoring device 100 may automatically deactivate in response to no longer receiving performance parameter data from the sensors 200. The device 100 may initiate a low-power, standby, or "sleep" mode in which power to one or more components is reduced or turned off. In this manner, the fitness monitoring device 100 may provide a "soft" off, which may allow a quicker and/or more efficient start up when the device is subsequently re-activated. Upon initiation of the deactivation procedure, the device 100 may further ensure that data files or other recordings are completely saved and not closed prematurely prior to deactivation. This may be desirable to avoid loss of recorded performance parameter data. Once the physical activity is complete, the athlete 10 may initiate wired or wireless transmission of any stored performance parameter data to the personal computer 600 and/or the server 602, as described below. Alternatively, the device 100 or the computer 600 and/or server 602 may initiate the transmission of data. In an embodiment, transmission of performance parameter or other data from the device 100 to the computer 600 and/or the server 602 may still occur even if the device is in a soft off, low-power state.

Information communicated to and stored by the personal computer 600 or the server 602 may be accessible to the athlete 10 at a later time. In the case of storage on the server 602, the athlete 10 may be able to access post-activity performance information communicated to the server 602 from their personal fitness monitoring device 100 at a later time from their personal computer 600 over the network 604. In another embodiment of the present invention, a third party (e.g. a trainer, coach, friend, or family member) stationed at a personal computer 600 may be able to access real-time or historical performance information regarding the athlete's 10 performance via the server 602 over the network 604.

Figure 4:
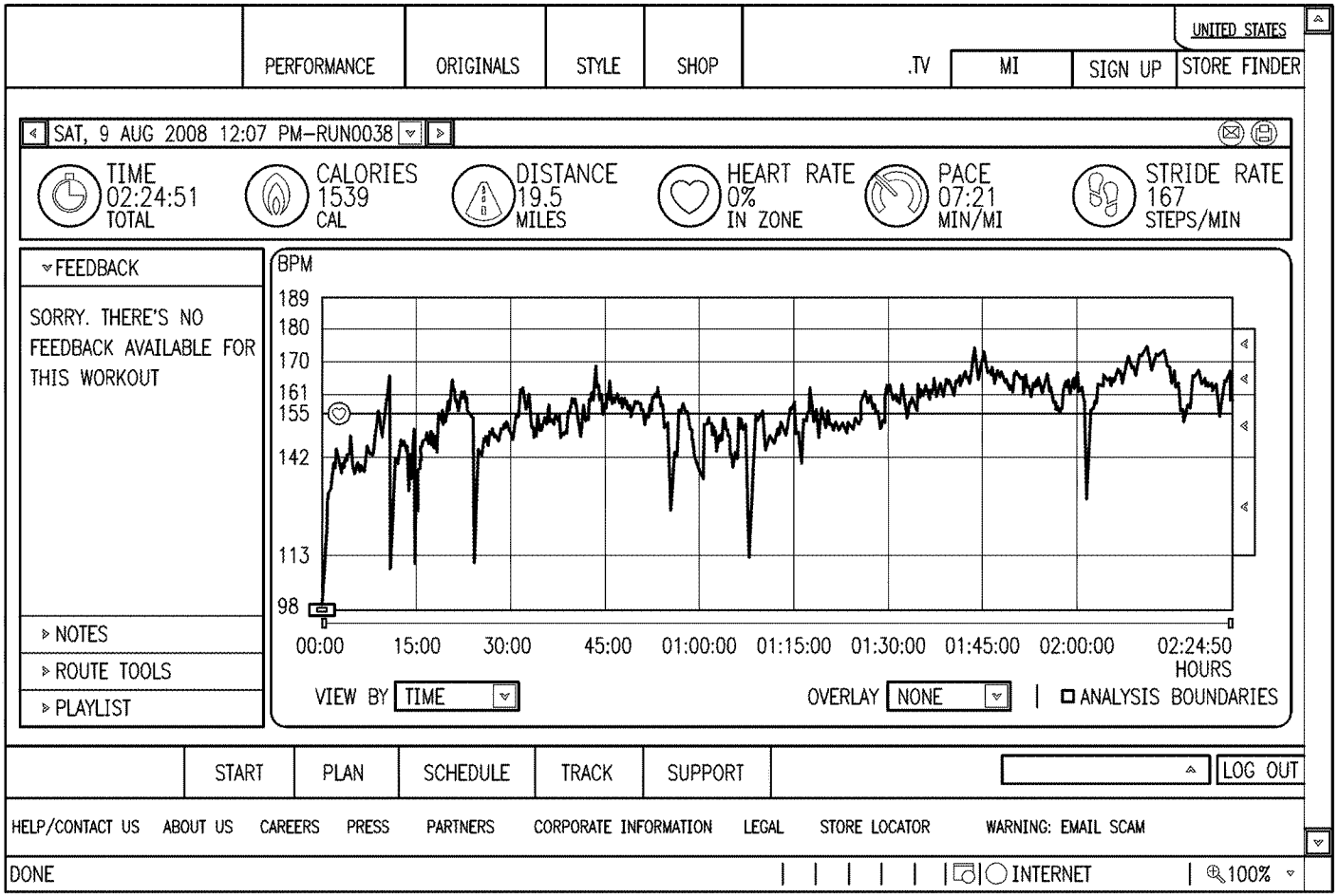
FIG. 4 is an illustration of a user interface according to an embodiment of the present invention.

The personal computer 600 and/or the server 602 may include software configured to include a number of different modules capable of providing various fitness monitoring services to athletes 10. Each module may support one or more graphical user interfaces (GUIs) (e.g., a webpage at a website accessible by the athlete via the Internet) capable of being presented to users 10 at personal computers 600. FIG. 4 is an exemplary illustration of a GUI window presented by a history module 606 showing a heart rate graph and other information derived from performance parameter data recorded during a physical activity and transmitted from the portable fitness monitoring device 100 to a personal computer 600 and/or a server 602. Other graphical user interfaces are disclosed in more detail in commonly owned U.S. patent application Ser. No. 12/468,025, filed May 18, 2009, which is incorporated herein by reference in its entirety.

Figure 5:
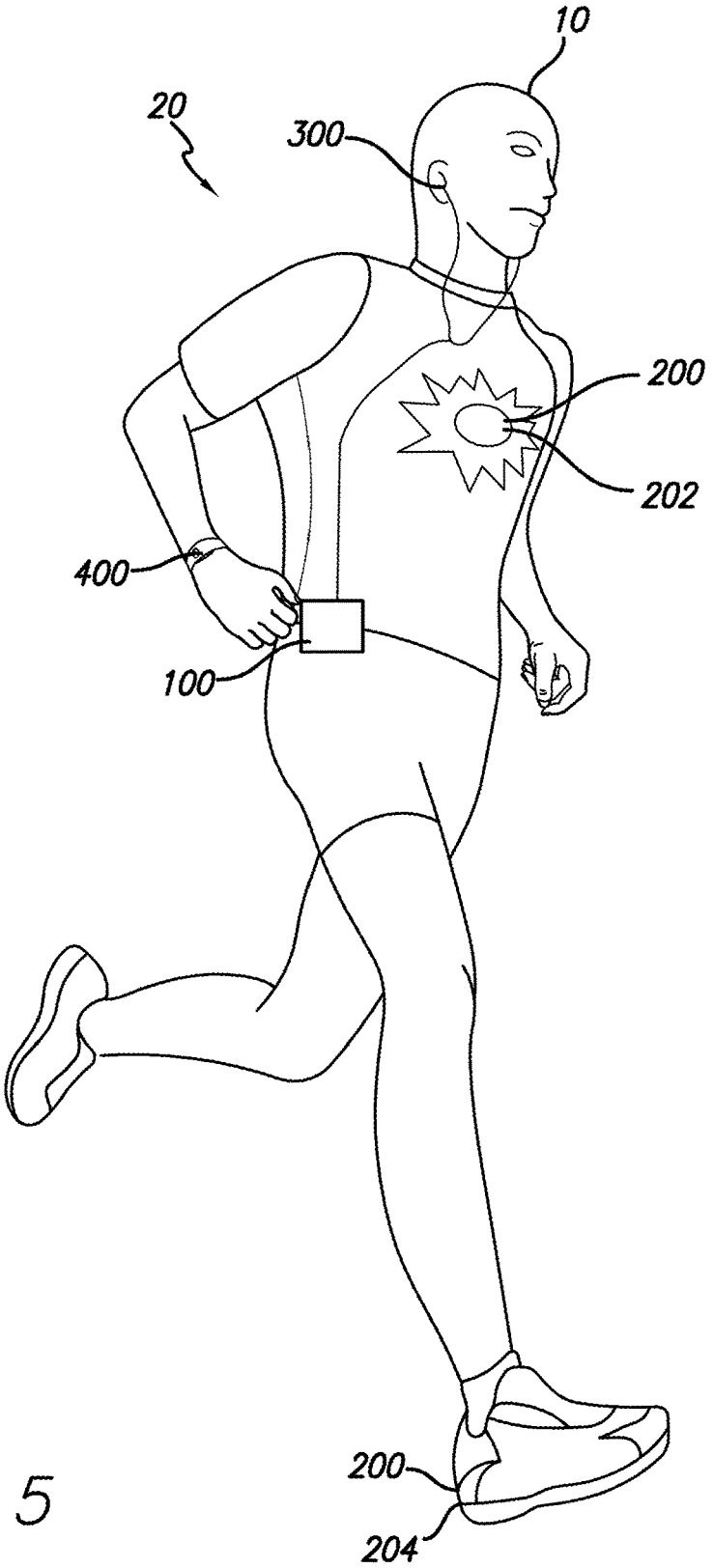
FIG. 5 is an illustration of an athlete using a portable fitness monitoring system according to an embodiment of the present invention.

With reference to FIG. 5 a portable fitness monitoring system 20 according to another embodiment of the present invention will now be described in which like reference numerals refer to like elements. The portable fitness monitoring system 20 may include a portable fitness monitoring device 100, portable sensors 200, an audio output device 300, and a visual display device 400. The portable fitness monitoring device 100 and the sensors 200 of the embodiment of FIG. 5 may have similar structures and functions to those described with respect to FIG. 1

In an embodiment, the audio output device 300 and visual display device 400 may not be included in the monitoring system 20 illustrated by FIG. 5. In one embodiment, an athlete 10 utilizing the portable fitness monitoring device 100 during multiple physical activities may chose to perform some physical activities without the audio output device 300 or the visual display device 400, some activities without the audio output device 300 but with the visual display device 400, some activities without the visual display device 400 but with the audio output device 300, and/or some activities with both devices 300 and 400. In this way, embodiments of the present invention may provide a flexible portable fitness monitoring system 20 capable of several different functional configurations to suit athletes' 10 various needs. Accordingly, the various components of the system 20 could be sold separately or together in any number of possible combinations.

In systems 20 including the audio output device 300, the device 300 may be a portable audio output device 300 coupled to the body of the athlete 10 adapted to provide audio content. The portable fitness monitoring device 100 may be capable of wired or wireless transmission of audio data to one or more audio output devices 300 via the audio output transmitter 112. In one embodiment, the audio output device 300 is a pair of headphones 302 and the audio output transmitter 112 is an audio output jack capable of receiving a headphone 302 jack plug. Other audio output devices 300, including, but not limited to, a speaker may be used.

In systems including the visual display device 400, the device 400 may be a portable visual display device 400 coupled to the body of the athlete 10 and may be capable of providing visual content. The portable fitness monitoring device 100 may be capable of wired or wireless transmission of visual data to one ore more visual display devices 400 via the visual display transmitter 114. In one embodiment, the visual display device 400 is a wristband 402 having one or more displays and the visual display transmitter 114 is a wireless transmitter including an antenna capable of transmitting visual data to the wristband 402. In one embodiment, the visual display device 400 may include a device as disclosed in U.S. patent application Ser. No. 12/467,948, filed May 18, 2009, which is hereby incorporated by reference herein in its entirety.

Figure 6:
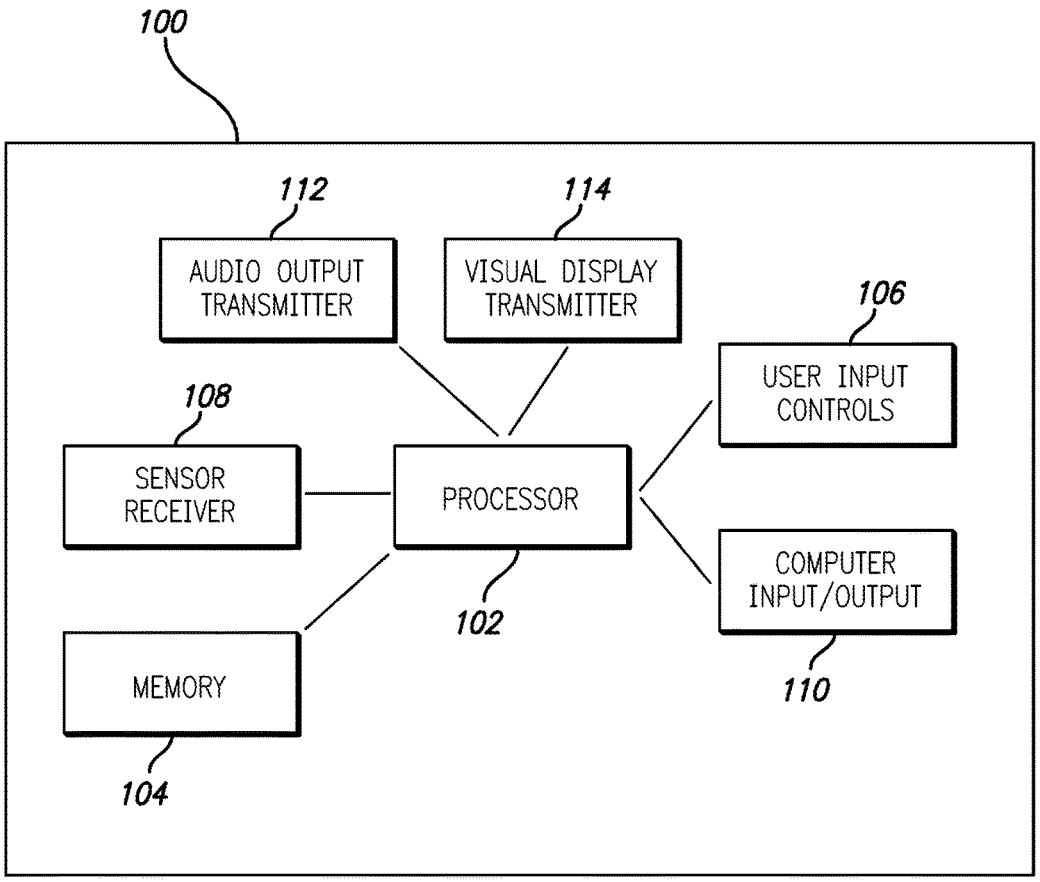
FIG. 6 is a block diagram of components of a portable fitness monitoring device according to an embodiment of the present invention.

With reference to FIG. 6, in one embodiment the portable fitness monitoring device 100 may include a processor 102, a memory 104, user input controls 106, a sensor receiver 108, a computer input/output 110, an audio output transmitter 112, and a visual display transmitter 114 operatively connected to provide the device 100 functionality.

The processor 102, the memory 104, the user input controls 106, the sensor receiver 108 (or transceiver), and the computer input/output 110 of the embodiment of FIG. 5 may have similar structures and functions to those described with respect to FIG. 2.

In the embodiment of FIG. 5, in addition to storing application program instructions and saving recorded performance parameter data, the memory 104 may also be used, for example, to store workout routines 608, as described in further detail below. The processor 102 may also be capable of executing the workout routines 608.

In the embodiment of FIGS. 5 and 6, the portable fitness monitoring device 100 may not include an integrally formed visual display or an integrally formed audio output device for providing performance feedback. This embodiment may, however, include transmitters 112 and 114 for wired or wireless transmission of visual or audio data to portable visual display devices 400 or audio output devices 300 supported by the body of the athlete 10. Accordingly, the portable fitness monitoring device 100 of FIGS. 5 and 6 may be capable of providing audio and visual information to the athlete 10 during the physical activity. In an embodiment, the transmitters 112 and/or 114 may be transceivers capable of bidirectional communication with one or more audio display devices 300 and/or visual display devices 400.

Information may be communicated between any of the personal fitness monitoring device 100, the personal computer 600, the network 604, and the server 602, in much the same way as described above with respect to FIG. 3. In addition to communicating performance parameters data, device settings (including portable fitness monitoring device 100, sensor 200, audio output device 300, and visual display device 400 settings), software, and firmware, the personal fitness monitoring device 100, the personal computer 600, the network 604, and the server 602 may also communicate workout routines 608 and audio performance feedback files 304, as described in further detail below.

Some of the portable fitness monitoring device 100 software, audio output device 300 settings, visual display device 400 settings, workout routines 608, and audio performance feedback files 304 may relate to a zone-based system. In the zone-based system of the present invention, zones may be defined, for example, as ranges of percentages of an athlete's 10 maximum heart rate or speed. Each zone may be associated with a particular color. An athlete's 10 maximum heart rate or speed may initially be provided to the portable fitness monitoring device 100, the personal computer 600, or the server 602 in a number of ways, such as those disclosed in commonly owned U.S. patent application Ser. No. 12/467,948, filed May 18, 2009, which is incorporated herein by reference in its entirety.

Figures 7, 8:
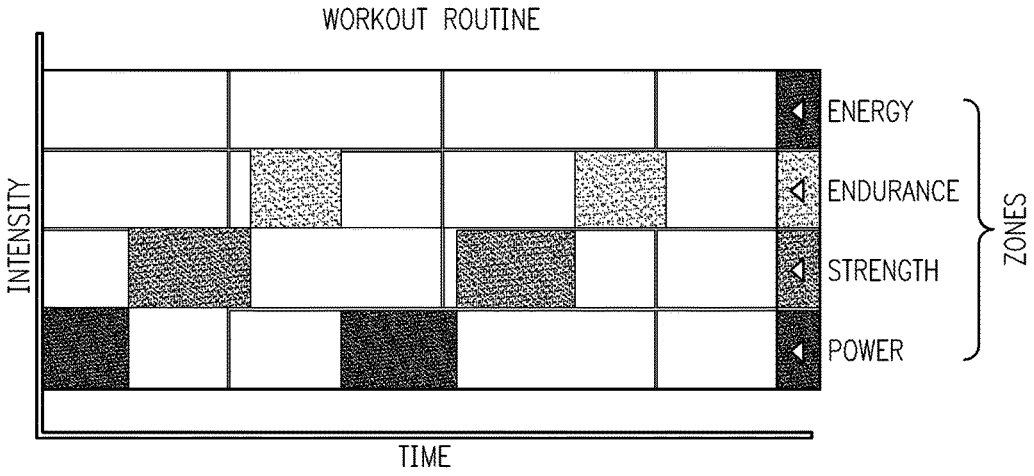
FIG. 7 is a table that illustrates heart rate zone ranges according to an embodiment of the present invention.
FIG. 8 is an illustration of a workout routine according to an embodiment of the present invention.

FIG. 7 is an exemplary illustration of zone definitions based on maximum heart rate for one embodiment of the present invention. An energy zone, ranging from 65% to 75% of an athlete's 10 maximum heart rate, may be associated with the color blue. An endurance zone, ranging from 75% to 85% of an athlete's 10 maximum heart rate, may be associated with the color green. A strength zone, ranging from 85% to 90% of an athlete's 10 maximum heart rate, may be associated with the color yellow. Finally, a power zone, ranging from 90% to 95% of an athlete's 10 maximum heart rate, may be associated with the color red. These ranges and color combinations are exemplary only; numerous other ranges and/or colors may be used.

The zones may be assigned based on predetermined fitness goals. For example, the energy zone (blue) may be associated with a heart rate range that allows an athlete 10 to build their aerobic base. The endurance zone (green) may be associated with a heart rate range that allows an athlete 10 to build cardiovascular strength and burn calories. The strength zone (yellow) may be associated with a heart rate range that allows an athlete 10 to improve their aerobic threshold and endurance. The power zone (red) may be associated with a heart rate range that allows an athlete 10 to improve their anaerobic threshold and metabolism.

Operation of the fitness monitoring system 100 shown in FIGS. 5 and 6 including a zone-based system will now be described according to an embodiment of the present invention. Before the athlete 10 begins a physical activity, the athlete 10 may secure the sensors 200 to his body and activate the portable fitness monitoring device 100 using one or more user input controls 106, as described above. The athlete 100 may also select a particular workout routine 608 from one or more workout routines 608 saved in the device 100 memory 104 via one or more of the user input controls 106, as described in further detail below. At this time, the portable fitness monitoring device 100 may identify and begin to communicate with sensors 200. The athlete 10 engages in physical activity and the sensor receiver 108 receives the performance parameter data.

When performance parameter data is continuously transmitted to the portable fitness monitor 100 in real time, the processor 102 may process the data in accordance with a program stored in the memory 104 embodying the zone-based system. For example if a heart rate zone-based system is employed and a user's 10 maximum heart rate has been input into the memory 104, performance feedback may be provided to the athlete 10 in real time via the audio output and/or visual display devices 300 and 400. For example, if the athlete 10 is exercising with a heart rate that the processor 102 determines is 80% of the athlete's 100 maximum heart rate, the audio output device 300 may announce "You are in the endurance zone" or "You are in the green zone." The visual display device 400 may illuminate a LED with the color green.

In one embodiment, the color emitted by the visual display device 400 that corresponds to a particular heart rate zone may change in character in response to changes in the measured heart rate occurring within the zone. For example, the a green light emitted may change in character in response to a measured heart rate increasing from a level near the bottom of the green zone to a heart rate level near the top of the green zone. The change in character may be, for example, a change in brightness or intensity. In an embodiment, the green light may change from a relatively light or dim light to a relatively dark or intense green as a user's 10 measured heart rate climbs upward through the green zone.

It will be appreciated that performance feedback may be provided to the athlete 10 in real time via the audio output and/or visual display devices 300 and 400 that is not tied to the zone-based system. For example, if the athlete 10 is exercising with a heart rate that the processor 102 determines is 80% of the athlete's 100 maximum heart rate, or 150 beats per minute, the audio output device 300 may announce "Your current heart rate is 150" or "Your current heart rate is 80% of your max." In one embodiment, the visual display device 400 may blink a LED at a rate that is proportional to the user's 10 heart rate.

In one embodiment, more advanced performance feedback or coaching tied to a workout routine 608 may be provided to the athlete 10. The personal computer 600 and/or the server 602 may include software configured to include a number of different modules capable of providing various fitness monitoring services to athletes 10. Each module may support one or more graphical user interfaces (GUIs) capable of being presented to users 10 at personal computers 600. FIG. 8 is an exemplary illustration of a GUI window presented by a plan module 610 illustrating a graphical representation of an athlete's 10 planned workout routine 608.

The athlete 10 may be able to utilize the plan module 610 to select a default workout routine 608, create a custom workout routine 608, or even select or customize an entire training plan comprised of individual workout routines 608. Workout routines 608 may be scheduled on a virtual calendar, or may be saved without being associated with a particular date. Workout routine 608 and plan creation is disclosed in more detail in commonly owned U.S. patent application Ser. No. 12/468,025, filed May 18, 2009, which is incorporated herein by reference in its entirety.

As illustrated in FIG. 8, the user 10 has selected or created a workout routine 608 including six different time intervals of different intensities, according to the zone-based system described above. The workout routine 608 may include, for example, a 5 minute warm up in the blue zone, then a 10 minute jog in the green zone, followed by a 5 minute run in the yellow zone. In the illustrated example, the athlete 10 would then repeat the series of blue, green, and yellow zone activities.

After a workout routine 608 is selected or created, it may be sent through wired or wireless transmission from the computer 600 or server 602 to the portable fitness monitoring device 100 via the computer input/output 110. One or more workout routines 608 may be received by the portable fitness monitoring device 100 and stored in the memory 104. The processor 102 may be capable of executing the workout routines 608.

In an embodiment, the portable fitness monitoring device 100 may be provided with a number of default or pre-loaded workout routines 608. In this way, the athlete 10 may be able to engage in physical activity while participating in a workout routine 608 without having first received a workout routine 608 from the computer 600 or server 602.

Before the athlete 10 begins a physical activity, the athlete 10 may secure the sensors 200 to his body and activate the portable fitness monitoring device 100 by using one or more user input controls 106, as described above. At this time, the portable fitness monitoring device 100 may identify and begin to communicate with sensors 200. The athlete 10 may also select from one or more workout routines 608 stored in the memory 104 using one or more user input controls 106. The athlete 10 may then engage in physical activity while being guided in accordance with the workout routine 608, as the sensor receiver 108 receives the performance parameter data.

For the workout routine 608 of FIG. 8, the portable fitness monitoring device 100 processing the workout routine 608 may provide preliminary audio coaching, such as, for example, "Let's get started" or "Increase your intensity to reach the blue zone." When performance parameter data is continuously transmitted to the portable fitness monitor 100 in real time, the processor 102 may process the data in accordance with the workout routine 608 and a program stored in the memory 104 embodying the zone-based system.

For example, if the user 10 is in the middle of their first five minute blue zone interval is maintaining a blue zone intensity, the portable fitness monitoring device 100 may announce "Your current heart rate is 125. You have achieved the target blue zone intensity. Maintain your blue zone intensity for another two minutes and thirty seconds." If the user 10 should be in a zone at a given time but is not, the portable fitness monitoring device 100 may provide appropriate guidance. For example, if the user 10 should be in the middle of their first 10 minute green zone interval but is only maintaining a blue zone intensity, the portable fitness monitoring device 100 may announce "Your current heart rate is only 125. Increase your intensity to enter the green zone." If the user 10 is at a yellow zone intensity, the portable fitness monitoring device 100 may announce "Your current heart rate is 145. Decrease your intensity to enter the green zone." When the user 10 finishes an interval and begins the next interval, the portable fitness monitoring device 100 may provide an indication and announce, for example, "You have completed a green zone interval. Increase your intensity to enter the yellow zone for five minutes."

In one embodiment, the visual display device 400 may also provide feedback via illumination of a LED. For example, in one embodiment, the color displayed by the LED may correspond to the current zone the athlete 10 is in, based on the currently sensed performance parameter data. As described above, the color may change in character in response to changes in the measured heart rate occurring within the zone.

In another embodiment, the color displayed by the LED may be used to guide the athlete in accordance with the workout routine 608. In an embodiment, the display device 400 may include two separate color display areas. For example, one color display area may include an LED, where the color of the LED changes in response to the current zone the athlete is in, based on their measured heart rate data, as described above. The other color display area may include another LED, where the color of the LED changes according to what zone the athlete should be in, based on their workout routine 608. Accordingly, one LED could provide the athlete 10 with an indication about which zone they are in, while the other LED could provide the athlete 10 with an indication about which zone they should be in.

In a further embodiment wherein the color displayed by the LED may be used to guide the athlete in accordance with the workout routine 608, only one color display area may be present. In this embodiment, the color of the LED may correspond to the current zone the athlete 10 is in, but the blink rate of the LED may indicate that the athlete 10 should speed up of slow down to achieve the desired zone. A rapid blink rate may signal the athlete 10 that he should increase his pace to get to a higher zone. A slow blink rate may signal the athlete 10 that he should decrease his pace to get to a lower zone. A solid non-blinking LED may indicate that the athlete 10 is in the proper zone.

In an embodiment, the visual display device 400 may be capable of displaying numerical performance parameter information such as, for example, a numerical heart rate number on, for example, a seven-segment LCD display. In one embodiment, the seven-segment LCD or other suitable display may be used to guide the athlete in accordance with the workout routine 608. For example, words such as "up" or "down" could be displayed to indicate to the athlete 10 that they should speed up or slow down to achieve the proper zone prescribed by the workout routine 608. In an embodiment, particularly when display space is relatively limited, abbreviations for commands may be displayed, such as the abbreviation "dwn" representing the word "down," or a command to slow down.

It will be appreciated that workout routines 608 may provide other limits or goals besides, or in addition to, those based on a color-coded zone system. Other feedback or coaching that may be provided by the audio display device 300 such as, for example, "You have 1 mile remaining to achieve your distance goal," "You have 5 minutes left to achieve your time goal," "You are moving at a personal best pace," "You have burned 300 calories so far," or "Increase your speed to 8 miles per hour to meet your goal."

The audio performance feedback conveyed to the athlete 10 via the audio output device 300 may be generated by a voice synthesizer or played from audio performance feedback files or file packages 304 stored in the memory 104. These files or file packages 304 may be downloaded from the computer 600 and/or the server 602. In one embodiment, different files or file packages 304 may be available based on the particular physical activity the athlete 10 wants to perform. Files or file packages 304 with different types or styles of voices may also be provided such as, for example, voices of different gendered speakers, voices with different accents, voices in different languages, voices from celebrities or fictional characters, and voices of different tones (e.g. supportive, calming, energizing, or stern).

In an embodiment, the feedback file packages 304 may be processed by language building software. Using this software, the processor 102 may be adapted to connect multiple feedback files 304 through a single index source to generate any feedback in a variety of languages or styles. For example, regardless of what language the device is set to broadcast in, the language building software will always call out the same reference location in the language package 304 for a desired feedback, and the feedback associated with that location can be translated into whatever language the device is set to.

A feedback file package 304 may include an array that will guide the language building program to the correct index file. This index file will have the address of the correct pointer file. The pointer file is adapted to then call up the audio files in the appropriate language and output them in the appropriate order.

Employing language building software and feedback file packages in this manner may offer several distinct advantages. First, it may allow the device to use audio files rather than device-generated, synthesized speech, which may sound more artificial. Second, it may allow the feedback provided to the user 10 to be extremely reconfigurable. The feedback file packages 304 can be stored in memory and can be easily changed or updated via downloads. Third, the system may be simplified in that the processor is always essentially seeking the same output data regardless of the language. Fourth, the language output may be more accurate because the sentence structure, word order, and/or other characteristics can be modified depending on the language.

For example, as illustrated in FIG. 16, if, according to the color-coded zone scheme described above, the device 100 needed to output the phrase 901 "blue zone," an English language feedback file package 304 may code the phrase "blue zone" at one phrase index 902 point, or may code the words "blue" and "zone" separately at different word index 903 points, and the software would be capable of outputting the words "blue" and "zone" in the correct order as the phrase 901 "blue zone". If a French language feedback file package 304 was being utilized instead, the feedback file package 304 may code the phrase 901 "zone bleue" at one phrase index 902 point, or may code the words "zone" and "bleue" separately at different word index 903 points, and the software would be capable of outputting the words "zone" and "bleue" in the correct order as the phrase 901 "zone bleue".

More specifically, when the device needs to generate a specific announcement, the processor 102 may call up an index file. This file has an address that is associated with the correct phrase/pointer file for the given announcement. Based on a data array, the phrase/pointer will then call up the appropriate audio files and properly sequence them. The array is set by the user 10 when they set their language preference, which may be done on the device 100 or from a remote computer 600. The array may also determine voice characteristics such as gender, accent, tones, or other characteristics described above.

FIGS. 9A-B is a table that illustrates exemplary audio performance feedback file package 304 contents for providing audio feedback to a user 10 during a workout according to an embodiment of the present invention. The table illustrates example file package 304 content that is appropriate, for example, for a 20 minute physical activity of yellow level of intensity interval.

As shown in the table of FIGS. 9A-B, certain trigger points may cause the device 100 to provide certain feedback. For example, when the user 10 starts their workout, this may cause the device 100 to announce "Let's get started." Next, when the user 10 has completed 25% of their workout, for example, this may cause the device 100 to announce "One quarter complete, 15 minutes left to go." Finally, when the user 10 finishes their workout, for example, this may cause the device 100 to announce "Nice Work. Time to cool down."

After the athlete 10 finishes the physical activity, the athlete 10 may deactivate the portable fitness monitoring device 100 by using a user input control 106. Alternatively, in one embodiment of the present invention, the portable fitness monitoring device 100 may provide a "soft" off, as described above. Prior to deactivation, the device 100 may audibly provide end of workout statistics to the athlete 10 through an audio output device 300, such as, for example, a speaker and/or headphones. The device may further audibly instruct the athlete 10 that all data has been saved. Once the physical activity is complete, the athlete 10—or the device 100, computer 600, or server 602—may initiate wired or wireless transmission of any stored performance parameter data from the device 100 to the personal computer 600 and/or the server 602, as described below.

In the embodiment of FIGS. 5 and 6, information may be communicated between any of the personal fitness monitoring device 100, the personal computer 600, the network 604, and the server 602, in much the same way as described above with respect to FIG. 3. In addition to communicating performance parameters data, device settings (including portable fitness monitoring device 100, sensor 200, audio output device 300, and visual display device 400 settings), software, and firmware, the personal fitness monitoring device 100, the personal computer 600, the network 604, and the server 602 may also communicate workout routines 608 and audio performance feedback files 304. Performance parameter data may also include information regarding the athlete's 10 performance with respect to the workout routine 608 utilized for the activity (e.g. how often was the athlete 10 in the desired zone). When viewed via a computer 600, the uploaded performance information may be displayed similarly to the display illustrated in FIG. 4.

With reference to FIG. 10, another embodiment of a portable fitness monitoring system 20 will now be described in which like reference numerals refer to like elements. As depicted in FIG. 10, in an embodiment, the portable fitness monitoring system 20 includes a portable fitness monitoring device 100, portable sensors 200, an audio output device 300, a visual display device 400, and a music device 500.

The portable fitness monitoring device 100, the sensors 200, the audio output device 300, and the visual display device 400 of the embodiment of FIG. 10 may have similar structures and functions to those described with respect to FIG. 5. The music device 500 may be a portable music device 500 coupled to the body of the athlete 10 and may be capable of providing music data.

FIG. 11 is an exemplary illustration of some of the components the portable fitness monitoring device 100 of FIG. 10. In this exemplary embodiment, the portable fitness monitoring device 100 may include a processor 102, a memory 104, user input controls 106, a sensor receiver 108 (or transceiver), a computer input/output 110, an audio output transmitter 112 (or transceiver), a visual display transmitter 114 (or transceiver), and a music device receiver 116 (or transceiver).

The portable fitness monitoring device 100 may be capable of wired or wireless reception of music data from the music device 500 via the music device receiver 116. The music device receiver 116 may be a transceiver capable of bidirectional communication with the music device 500.

In one embodiment, the music device 500 is a digital music file player 502 (e.g. an MP3 player) and the music device receiver 116 is an audio input jack. The digital music file player 502 may include an audio output jack 504. A cable having suitable jack plugs on both ends may be used to transfer music data from the digital music file player 502 to the portable fitness monitoring device 500 when the jack plug ends are plugged into the audio output jack 504 of the digital music file player 502 and the audio input jack 116 of the portable fitness monitoring device 100. In one embodiment, a USB cable, such as the one described above, may be used. In another embodiment, music data is sent from the digital music file player 502 to the portable fitness monitoring device 100 wirelessly. The portable fitness monitoring device 100 may be adapted to draw power from the music device 500 while the music device is operatively connected through the audio output jack 504.

The music device 500 may also have a data port 506. In embodiments where the music device 500 is a digital music file player, the data port 506 may allow the digital music file player 502 to connect to the computer 600, the server 602, or another network source to download digital music files 508 or other music data, either before a workout or in real-time (e.g. by wireless data streaming).

The digital music file player 502 may be any device capable of playing digital music files 508, such as, for example, an MP3 player or a music-capable phone.

Other music devices 500 including, but not limited to, for example, tape players, CD players, minidisk players, mobile phones, smart phones, PDAs, or devices capable of playing radio broadcasting content (including content from terrestrial, satellite, and internet radio stations) are also within the scope of the present invention. The data port 506 of these devices may be any component capable of receiving music, such as, for example, a jack or an antennae. In addition to its standard meaning, the term "music" as used herein may also include non-musical spoken word content including, but not limited to, content typically provided through talk radio shows, podcasts, lectures, seminars, speeches, news pieces, or audio books.

The components of the portable fitness monitoring device 100 such as the processor 102, the memory 104, the user input controls 106, the sensor receiver 108 (or transceiver), the computer input/output 110, the audio output transmitter 112 (or transceiver), and the visual display transmitter 114 (or transceiver) of the embodiment of FIG. 11 may have similar structures and functions to those described with respect to FIG. 6.

In the embodiment of FIGS. 10 and 11, in addition to storing application program instructions and saving recorded performance parameter data, and in addition to storing workout routines 608, the memory 104 may also be used, for example, to store software for interfacing with the music device 500, as described in further detail below. The processor 102 may also be capable of processing such software.

Information may be communicated between any of the personal fitness monitoring device 100, the personal computer 600, the network 604, and the server 602, or other network source, in much the same way as described above with respect to FIG. 3. In embodiments where the music device 500 is capable of separately communicating with a computer 600 and/or a server 602, possibly via a network 604, such communication may also be achieved in much the same way as described above with respect to FIG. 3.

Some of the portable fitness monitoring device 100 software, audio output device 300 settings, visual display device 400 settings, workout routines 608, and audio performance feedback files 304 used in the embodiments of FIGS. 10 and 11 may relate to the zone-based system described above with respect to FIGS. 7-9.

In one embodiment, the portable fitness monitoring device 100 may be used primarily as a passive data logger, as described above with respect to FIGS. 1 and 2. However, a user 10 passively logging their data may also want to utilize an audio output device 300 to output music during their physical activity.

Before the athlete 10 begins the physical activity, the athlete 10 may secure the sensors 200 to his body and activate the portable fitness monitoring device 100 using one or more user input controls 106, as described above. At this time, the portable fitness monitoring device 100 may identify and begin to communicate with sensors 200. The athlete may also activate the music device 500 of their choice and establish a wired or wireless connection between the music device 500 and the portable fitness monitoring device 100. The athlete may secure the music device 500 to his body, as illustrated in FIG. 10, or the athlete may choose to store the music device 500 in a backpack, pocket, or other relatively concealed location.

As the athlete 10 engages in physical activity and the sensor receiver 108 receives the performance parameter data, as described above, the athlete may be provided with music sent from the music device. Specifically, in one embodiment, music data may be transferred from the music device 500, out of the audio output 504, to the portable fitness monitoring device 100, in through the music device input 116. Then the music data may further be transferred from the portable fitness monitoring device 100 to the audio output device 300, such as headphones 302, similarly to the way that audio performance feedback was output to the user 10, as described above with respect to FIGS. 5 and 6.

In another embodiment, the portable fitness monitoring device 100 may be used to provide audio and/or visual performance feedback information to the athlete 10, as described above with respect to FIGS. 5 and 6. However, a user 10 receiving audio and/or visual performance feedback via the audio output device 300 may also want to listen to music during their physical activity via the audio output device 300.

If the user 10 has chosen to receive visual but not audio performance feedback, music data may be transferred from the music device 500 through the portable fitness monitoring device 100 so that music is output from the audio output device 300 to the user 10, similar to the way that music could be output to a user 10 employing the portable fitness monitoring device 100 primarily as a music-playing passive data logger, as described above.

If, however, the user 10 has chosen to receive audio performance feedback (either with or without visual feedback), the portable fitness monitoring device 100 may act as a controller for determining when a particular audio output should occur.

In this embodiment, before the athlete 10 begins the physical activity, the athlete 10 may secure the sensors 200 to his body and activate the portable fitness monitoring device 100 using one or more user input controls 106, as described above. At this time, the portable fitness monitoring device 100 may identify and begin to communicate with the sensors 200. The athlete 10 may also select from one or more workout routines 608 stored in the memory 104 using one or more user input controls 106, as described above. The athlete may also activate the music device 500 of their choice and establish a wired or wireless connection between the music device 500 and the portable fitness monitoring device 100. The athlete may secure the music device 500 to his body, as illustrated in FIG. 10, or the athlete may choose to store the music device 500 in a backpack, pocket, or other location.

The athlete 10 may then engage in physical activity while listening to music and being guided in accordance with the workout routine 608, as the sensor receiver 108 receives the performance parameter data.

In one embodiment, music may be played throughout the entire physical activity, and any audio performance feedback may be played on top of—or simultaneously with—the music. In another embodiment, the music may be modified—for example, it may be paused, muted, or its volume may reduced—while the audio performance feedback is being provided. In this case, the processor 102 of the portable fitness monitoring device 100 may act as an audio controller. The controller functions of the portable fitness monitoring device 100 may achieved by suitable software stored in memory 104. In one embodiment, a user input control 106 in the form of a switch may be provided on a surface of the portable fitness monitoring device 100 that allows the user to selectively enable one or more of the data logging, performance feedback, and/or music functions.

The portable fitness monitoring device 100 may include an input control 106 in the form of a volume control for controlling the volume of the audio output. In one embodiment, the portable fitness monitoring device 100 volume control may only control the volume of the performance feedback audio, while the volume of the music derived from the music device 500 may be controlled by a volume control coupled to the music device 500.

In an embodiment where the music is modified by audio performance feedback, the volume of the performance feedback audio may be set based on the volume of the music just prior to the modification of the music by the performance feedback audio. For example, the volume of the audio performance feedback may be set to be equal to the volume of the music just prior to the modification. In one embodiment, the volume of the performance feedback audio may be set by analyzing a sample audio waveform or other volume indication of recently played music data. In another embodiment, the volume may be set by comparing a sample audio waveform or other volume indication of recently played music data to one or more stored audio performance feedback files.

With reference to FIGS. 12-15, a portable fitness monitoring device 100 according to another embodiment of the present invention will now be described in which like reference numerals refer to like elements. The portable fitness monitoring device 100 of FIGS. 12-15 may have similar structures and functions to those of the portable fitness monitoring devices 100 described above.

FIG. 12 is a front view of a portable fitness monitoring device according to an embodiment of the present invention. In an embodiment, the portable fitness monitoring device 100 may be capable of wired or wireless communication with sensors 200, audio output devices 300, visual display devices 400, music devices 500, and/or personal computers 600 and servers 602, as described above.

As illustrated in FIG. 12, the portable fitness monitoring device 100 may include a housing 900 with integrally formed displays. The housing may be made of plastic, such as, for example, TPU, or other suitably durable material. In an embodiment, the integrally formed displays may be capable of presenting non-performance parameter-based information. For example, as shown in FIG. 12, the portable fitness monitoring device 100 may include a heart rate sensor indicator 902, an accelerometer indicator 904, and a general indicator 906.

The heart rate sensor and accelerometer indicators 902 and 904 may include LEDs or other suitable light sources capable of providing information about the heart rate sensor 202 and accelerometer 204 to the user 10. In an embodiment, the LEDs and the housing 900 may be configured such that the heart rate sensor indicator 902 appears to be heart shaped and the accelerometer indicator 904 appears to be the shape of an article of footwear. The LEDs of the indicators 902 and 904 may be capable of providing different colors and/or different LED blink rates.

In one embodiment, the indicators 902 and 904, such as LEDs, may constantly emit green light if their corresponding sensor 200 has been found and is in communication with the portable fitness monitoring device 100. The indicators 902 and 904 may constantly emit red light if their corresponding sensor has not been found or is otherwise not able to communicate with the portable fitness monitoring device 100. In an embodiment, the indicators 902 and 904 may blink red light while they are searching for their corresponding sensor 200, and may blink green light if the device 100 is paused.

The general indicator 906 may include one or more LEDs or other suitable light sources capable of providing a variety of information about the device 100. In one embodiment, the general indicator 906 may emit blue light when the device is connected to a computer 600 or a server 602, a green light when the device 100 battery has a relatively high level of power remaining, and a red light when the device 100 battery has a relatively low level of power remaining. As will be appreciated to those of skill in the art, other suitable colors and representations for the indicators may be used.

With reference to FIGS. 12 through 15, the housing 900 of the portable fitness monitoring device 100 may include one or more user input controls 106 for performing various functions. In one embodiment, the device 100 user input controls 106 may include a selector button 908, a mode switch 910, an info button 912, a pause button 914, and a volume button 916. As described briefly above, in some embodiments, any of the input controls 106 could be capacitance switches.

The selector button 908 may allow the user to select a particular input or respond to a particular query from the device 100. In one embodiment, the selector button 908 may be used to select a workout routine 608 from one or more workout routines 608 stored in the device 100 memory 104. For example, a user 10 may have ten workout routines 608 stored in the memory 104 of their device. When the user 10 turns on their device 100 and is ready to select a particular workout, the device may provide an indication of the first stored workout routine 608 to the user. The indication may be, for example, audio output via the audio output device 300. The audio output may announce, for example, "Long run," "Workout number 47," "Workout for Saturday Mar. 7, 2009," or the like.

In one embodiment, if the user 10 wishes to run the first stored workout routine 608, the user may press and hold the selector button 908, for example, for 3 seconds. The device 100 will then execute the first stored workout routine 608. If the user 10 wishes to browse through the other workout routines 608 stored in the memory 104, the user 10 may press the selector button 908 for less than three seconds, thus prompting the device 100 to provide an indication of the next workout routine 608 stored in memory 104. The user 10 may thus advance through all of the stored workout routines 608 in a similar manner until the preferred routine 608 is selected.

Other suitable means for manipulating the selector button 908 for selecting a stored workout routine may be used. For example, the user 10 may browse through the stored workout routines 608 by pressing the selector button 908, and may press another button, such as info button 912, when to select a specific workout routine 608 after they have navigated to it via the selector button 908. In this manner, a "press and hold" button function may not be necessary.

In another embodiment, workout routines may be selected using voice-activated controls, thus eliminating the need for the selector button 908.

The mode switch 910 may allow the user 10 to select from one or more operating modes of the device 100. In one embodiment, several operating modes, which may include modes corresponding to functionalities described above with respect to various embodiments, may be enabled. As illustrated in FIG. 13, which is a back view of the portable fitness monitoring device 100, the mode switch may be set to one of several indicia corresponding to different modes.

In one embodiment, the mode switch may allow the user 10 to toggle between off, free, and coaching modes. The off mode may correspond to a mode where the device is powered off. The free mode may correspond to a mode where audio performance feedback is not automatically provided to the user 10, as described above. The coaching mode may correspond to a mode where audio performance feedback is automatically provided to the user 10, as described above, including feedback provided in conjunction with a stored workout routine 608.

Regardless of whether the device is operating in free mode, coaching mode, or any other mode, in an embodiment, the user 10 may be able to receive feedback on demand by actuating the info button 912. As illustrated in FIG. 12, the info button 912 may be a large flat button centrally located within the front surface of the housing 900 of the device 100. At any time during a physical activity, a user may press the info button 912 to receive instant performance feedback. In an embodiment, specific feedback such as elapsed time, current heart rate, current pace, and elapsed distance are always provided in response to actuation of the info button 912. In another embodiment, the particular performance parameters or other feedback provided to the user may be specified using a computer 600, as described in further detail in commonly owned U.S. patent application Ser. No. 12/468,025, filed May 18, 2009, which is incorporated herein by reference in its entirety.

In another embodiment, the user 10 may be able to receive feedback on demand by requesting such feedback using voice-activated controls.

In a further embodiment of the present invention, the info button 912 may function as a mute button to mute any audio being output to the user.

The portable fitness monitoring device may also include pause and volume buttons 914 and 916. In one embodiment, the pause 914 button may be in the shape of a runner, while the volume button 916 may appear in the shape of consecutive sound waves.

The user 10 may actuate the pause button 914 to pause a data logging and/or workout routine 608 execution. This may be desirable when the user 10 is forced to temporarily halt their physical activity or considerably slow their pace, for example, when they must stop for a traffic signal. Actuating the pause button 914 an additional time may resume the data logging and/or workout routine 608 execution.

The user 10 may actuate the volume button 916 to manually increase or decrease the volume level of the performance feedback information provided by the device 100. In one embodiment, there may be five different sound level settings. Each time the user 10 actuates the volume button 916, the volume level may increase from one level to the next. After the volume level has reached its highest level, subsequent actuation of the volume button 916 will bring the volume to its lowest level. The user 10 may actuate the volume button 916 repeatedly to achieve a desired volume level.

FIG. 13 is a back view of a portable fitness monitoring device 100 according to one embodiment of the present invention. As illustrated in FIG. 13, the portable fitness monitoring device 100 may include an input port 918, an output port 920, and a mounting means 922.

In an embodiment, the input port 918 may be a jack capable of receiving a jack plug of a cable. The cable may be capable of connecting to a music device 500 for transmitting music data, as described above. The cable may also be capable of connecting to a personal computer 600 for transmitting a variety of information, as described above. Accordingly, the input port 918 may function as both a computer input/output 110 and a music device input 116, as described above. In one embodiment, the cable may be a jack plug-to-jack plug cable capable of connecting to the input port 918 of the device 100 on one end and a device with a suitable jack at the other end. In another embodiment, the cable may be a jack plug-to-USB cable capable of connecting to the input port 918 of the device 100 on one end and a device with a USB port at the other end. Other suitable cables may also be used.

In one embodiment, the output port 920 may function as the audio output transmitter 112, as described above. Accordingly, a jack from a headphone 302 cable may be plugged into the output port 920 jack plug to enable audio output.

With reference to FIG. 14, the device 100 may also include mounting means 922. In one embodiment of the present invention, the mounting means 922 may be a clip secured to the back side of the device. The clip 922 may be capable of clipping to, for example, a user's 10 waistband, belt, or shirt. Other mounting means 922, including, but not limited to, VELCRO®, buttons, snaps, or the like may be used.

In one embodiment of the present invention, the fitness monitoring device 100 may include recording means. As will be appreciated to those of skill in the art, the processor 102 and the memory 104 may be adapted such that the device may operate as a voice recorder. In addition, the fitness monitoring device 100 may include audio input means, such as, for example, a microphone. The athlete 10 may utilize the recording means during a workout to record real time workout notes. After the workout, the notes may be used to provide additional feedback about the athlete's fitness level, the workout routine 608, or the operation of the device. For example, during the workout the athlete may identify and record that a particular heart rate zone is inaccurate. This information may then be used to dynamically adjust the range of a heart rate zone.

In one embodiment, the portable fitness monitoring device 100 may be used to communicate over a mobile telephone network. In an embodiment, the music device 500 coupled to the portable fitness monitoring device 100 may be a music-capable mobile telephone. The processor 102 of the portable fitness monitoring device 100 may be capable of placing and receiving telephone calls over a mobile network in conjunction with the mobile phone. The audio output device 300 may be a pair of headphones 302 that include a microphone capable of receiving voice inputs, as described above.

Accordingly, embodiments of the present invention may provide a portable fitness monitoring device 100 having improved functionalities, such as the ability to utilize a portable fitness monitoring device 100 with performance data logging, performance feedback, and/or music capabilities, thus offering the individual 10 a variety of options while exercising. Embodiments of the portable fitness monitoring device 100 may be less complex, more portable, and more flexible that existing monitoring devices. The portable fitness monitoring device 100 may be able to accept input from almost any audio music device 500, thereby allowing the user to carry a music device 500 that they are already familiar with. Furthermore, because the portable fitness monitoring device 100 may include all necessary software and hardware for implementing the fitness monitoring aspects of the present invention, they user need not purchase a music device 500 with special fitness monitoring software or hardware, and need not download special software to their existing music device 500.

In embodiments employing the color-coded zone-based system described above, after the zones have been initially defined, the portable fitness monitoring system 20 may be adapted to selectively adjust the limits of the zones in response to the athlete's 10 performance and/or feedback received from the athlete, if such adjustments are warranted. In this manner, the portable fitness monitoring system 20 may provide a training feedback loop. As described above, the zones may be defined based on user input. User performance parameter data is detected during a physical activity via the sensors 200, as described above. The performance parameter data is transmitted to the computer 600 and/or the server 602 for processing. A determination is made as to whether the zones need to be adjusted. If adjustments are warranted, this data is communicated back to portable fitness monitoring device 100.

The determination as to whether or not the zones need to be adjusted may be based on performance data (e.g., heart rate data) and/or feedback received from the athlete 10. With respect to performance data, factors may include, for example, the athlete's 10 consistency during a particular physical activity, their rate of recovery after the activity, or their performance during specific interval training sessions, as specified by a workout routine 608. For example, the athlete 10 may use the fitness monitoring system 20 during workout routine 608 in which the intervals are based on maintaining a heart rate within a particular heart rate zone during the interval. If the athlete performs outside the specified heart rate zone for all or a portion of the interval, the heart rate zone may be adjusted. For example, if the athlete 10 is consistently above the specified zone, the zone range may be increased. If the athlete 10 is consistently below the specified zone, the zone range may be decreased.

Determinations may further be influenced by feedback provided by the athlete 10. For example, the athlete 10 may provide responses to questions posed by the portable fitness monitoring system 20. For example, upon uploading recently recorded performance parameter data, or upon logging in to the computer 600 and/or sever 602, a GUI pop-up window may appear asking the user 10, for example, if they thought the workout routine 608 was too difficult or too easy. If the user responds that a workout routine 608 was too difficult, the zone range may be incrementally decreased. If the user responds that a workout routine 608 was too easy, the zone range may be incrementally increased.

In one embodiment of the present invention, the portable fitness monitoring device 100 may be a GPS-enabled portable fitness monitoring device 100. When the athlete's physical activity includes traversing a route (e.g. running or biking outdoors), the GPS-enabled portable fitness monitoring device 100 may capable of recording an athlete's 10 geographic way points along the route traversed. Either during traversal of the route or after the route has been completed, GPS data could then be uploaded to a computer 600 and/or server 602 and associated with other performance monitoring information collected during traversal of the route.

In an embodiment, the GPS-enabled portable fitness monitoring device 100 may be able to guide the athlete 10 along a planned route. A route plan, which may or may not be associated with a workout routine 608, may be created or selected that specifies a particular route for the athlete to travel. In an embodiment, the route plan is created on a personal computer 600 and downloaded to the portable fitness monitoring device 100. Athletes 10 may use route plans they themselves have created and stored on a computer 600 or a sever 602. In one embodiment, athletes 10 may post and share route plans with others via an online fitness monitoring service, such as that disclosed in more detail in commonly owned U.S. patent application Ser. No. 12/468,025, filed May 18, 2009, which is incorporated herein by reference in its entirety. The online fitness monitoring service may provide interfaces where a plurality of users can create, store, share, and find route plans of interest.

As the athlete 10 begins to conduct their physical activity, the audio output device 300 of the portable fitness monitoring device 100 may announce turn by turn directions to the athlete, based on the route plan and the athlete's 10 current position based on GPS readings. For example, the device 100 may announce "Turn left in 10 meters," "Turn left at Main Street," or "Take a left at the fork in the bike path."

In addition to providing route guidance, in one embodiment, the GPS-enabled portable fitness monitoring device 100 may be capable of providing other audio cues or narrations. These narrations may be tied to specific athletic events, venues, or courses. The particular narration announced may be triggered by the athlete's 10 current position based on GPS readings and/or a narration package downloaded by the athlete 10. In one embodiment, an athlete 10 running in the Boston Marathon may have previously downloaded a Boston Marathon narration package to his device 100. When the athlete 10 reaches certain points along the race course, based on his GPS readings, the device 100 may announce race or course specific narrations, historical information, or any other general point-of-interest information.

In another embodiment, narrations may be provided not based on the athlete's 10 GPS-based position but based on the distance they have traveled on a known course. GPS or non-GPS-based distance sensors (e.g. pedometers) may be used to determine the distance traveled. In the example of an athlete 10 running in the Boston Marathon, the athlete 10 could download a Boston Marathon-specific narration package to his device 100 prior to the race. Based on the distance traveled by the athlete 10 on the known course, the device 100 may announce race or course specific narrations, historical information, or any other general point-of-interest information.

In a further embodiment, the device may combine information with narration packages with performance-related feedback information. For example, an athlete 10 running the Boston Marathon course could receive audio output announcing "You are approaching Heartbreak Hill in 10 meters—try to stay in the green zone."

Embodiments where the portable fitness monitoring device 100 includes an integrally formed visual display and/or an integrally formed audio output device should be understood to be within the scope of the present invention.

As described in detail above, embodiments of the present invention may contain one or more user input controls 106. These user input controls 106 may be used by the athlete 10 to interact with the portable fitness monitoring device 100. While exemplary embodiments discussed thus far have mostly focused on embodiments where the input controls 106 are buttons, switches, or keys, some embodiments may utilize one or more input controls 106 that include means for receiving voice activated user input (i.e., voice-activated controls).

Means for receiving voice activated user input may be any controls capable of reacting to the athlete's 10 voice. Some embodiments may exclusively include voice activated controls. As such, in some embodiments, the device 100 may be adapted to be controlled by a user without manual input means. Voice activated controls may offer an advantage of allowing the athlete 10 to easily operate the device 100 without using their hands, breaking their athletic form, or drawing their visual attention away from their physical activity. Those of skill in the art will be familiar with a variety of commercially available voice-activated command software products such as, for example, Voice Command from Microsoft Corporation of Redmond, Wash.

If a microphone or other audio input means and appropriate software are included, athletes 10 may be able to provide any input to the device 100 that may otherwise have been input using input buttons, switches, or keys, such as buttons and switches 908, 910, 912, 914, and 916, described above. For example, the user 10 may be able to receive feedback on demand by vocally asking the device 100 for it, whereas they otherwise would have had to actuate the info button 912. A user could say "heart rate," and the device may announce their current heart rate. Or the user could say "zone," and the device may announce their current and/or target zone. Of the user could say "info," and the device may provide several pieces of default feedback such as, for example, elapsed time, current heart rate, current pace, and elapsed distance.

The user 10 may also be able to respond to questions from the device 100 and/or provide personal information such as their name, gender, age, or maximum heart rate to the device 100.

In an embodiment of the present invention, the portable fitness monitoring device 100 may be capable of providing control prompts through said audio output device. These control prompts may or may not be provided in conjunction with a microphone and the voice activated controls described above. For example, in one embodiment the user 10 may actuate manual user input controls 106 in response to audio control prompts, while in another embodiment the user 10 may speak into the microphone in response to the audio control prompts.

In an embodiment, the audio control prompts are delivered via a nested menu system, such as those often used in voicemail systems. After the device 100 is activated, the processor may run through a series of predetermined questions. Based on the user's 10 response, the device may provide additional control prompts or initiate an activity. For example, the device 100 may ask "Would you like to conduct the Long Run workout routine?", "Which workout routine would you like to conduct?", "Would you like to record and log your data today?", "Are you ready to begin?", or any number of other suitable prompts.

In one embodiment, the audio control prompts provided through said audio output device may not be accompanied by corresponding visual output, such as when the device 100 does not include an integrally formed display.

Embodiments of the present invention may include a power source, such as, for example, a battery contained in the portable fitness monitoring device 100 for providing power to the device 100. In some embodiments, if the portable fitness monitoring device 100 is connected to a music device 500, the monitoring device 100 may be able to draw power from the music device 500. Accordingly, the weight, size, cost, and complexity of the portable fitness monitoring device 100 could be reduced by inclusion of a less powerful battery compared to devices 100 employing more powerful batteries.

Furthermore, in some embodiments, the housing 900 of the portable fitness monitoring device may be integrally formed with and/or physically engaged with the heart rate sensor 202. Accordingly, the athlete 10 may only need to purchase and use a single device 100 that may incorporate heart rate data logging and performance feedback capabilities. As described in detail above, such a device could be coupled to a music device 500 to provide music.

In addition, embodiments where the portable fitness monitoring device 100 itself stores and outputs music data should be understood to be within the scope of the present invention.

Furthermore, embodiments where the portable fitness monitoring device 100 interacts with an electronic game should be understood to be within the scope of the present invention.

While some embodiments have been described as including a sensor 200 and a portable fitness monitoring device 100 with a sensor receiver 108, in an embodiment of the present invention, these elements may not be present. In another embodiment, these embodiments may be present, but may not be utilized by the user 10. For example, in an embodiment, the device 100 may provide coaching via the audio output device 300 that may or may not be tied to a workout routine 608. The coaching may instruct the user 10 on the types of activities, intensities, and/or time intervals they should be exercising in accordance with, but may not base the instructions on sensory feedback because, in an embodiment, sensors 200 may not be utilized.

While various communications components of the system 20 of the present invention, including components of the portable fitness monitoring device 100, may have been described as a "receiver," "transmitter," "input," "output," or any other one-way communications component, it should be understood that transceivers or other bidirectional communications components could be substituted for their one-way counterparts. Likewise, in many cases, one-way communications components could be substituted for bidirectional communications components.

The present invention has been described above by way of exemplary embodiments. Accordingly, the present invention should not be limited by any of the above-described exemplary embodiments, but should be defined only in accordance with the following claims and their equivalences.

What is claimed is:

1. A method for providing audible output to a user during an athletic activity using a portable fitness monitoring device, comprising the steps of:

the portable fitness monitoring device receiving user input comprising selecting a tone indicating a desired style of audio feedback;

the portable fitness monitoring device generating a data array based on the user input;

the portable fitness monitoring device selecting an audio feedback file package based on the user input, and processing the selected audio feedback file package to provide audible output to the user during the athletic activity, wherein the processing comprises generating an audio feedback phrase based on an association between the data array and an index source;

the portable fitness monitoring device providing preliminary audio coaching prior to commencement of the athletic activity in a first tone of audio feedback; and the portable fitness monitoring device providing coaching feedback during the athletic activity in a second tone of audio feedback that differs from the first tone.

2. The method of claim 1, wherein the selected audio feedback file package comprises a first audio feedback file and a second audio feedback file associated through the index source, and wherein generating the audio feedback phrase is based on the association of the first and second audio feedback files through the index source and the data array.

3. The method of claim 1, wherein the selected audio feedback file package comprises a first audio feedback file including an audio feedback phrase in a first tone, and a second audio feedback file including the same audio feedback phrase in a second tone that differs from the first tone.

4. A method for providing audible output to a user during an athletic activity using a portable fitness monitoring device, comprising the steps of:

the portable fitness monitoring device receiving user input indicating a desired type of audio feedback;

the portable fitness monitoring device selecting an audio feedback file package based on the user input, and processing the selected audio feedback file package to provide audible output to the user during the athletic activity, wherein the processing comprises generating an audio feedback phrase;

the portable fitness monitoring device providing preliminary audio coaching prior to commencement of the athletic activity in a first type of audio feedback; and the portable fitness monitoring device providing coaching feedback during the athletic activity in a second type of audio feedback that differs from the first type.

5. The method of claim 4, wherein the type of audio feedback comprises a tone selected from one of supportive, calming, energizing, and stern.

6. The method of claim 5, further comprising:

the portable fitness monitoring device providing preliminary audio coaching prior to commencement of the athletic activity in a first tone of audio feedback; and the portable fitness monitoring device providing coaching feedback during the athletic activity in a second tone of audio feedback that differs from the first tone.

7. The method of claim 5, wherein generating the audio feedback phrase varies in response to the type of audio feedback tone desired.

8. The method of claim 4, wherein the type of audio feedback comprises one of a celebrity voice and a fictional character voice.

9. The method of claim 4, further comprising:

the portable fitness monitoring device generating a data array based on the user input, and wherein selecting the audio feedback file package is based in part on the data array.

10. The method of claim 9, further comprising:

the portable fitness monitoring device selecting an audio feedback file within the audio feedback file package based on an index source and the data array.

11. The method of claim 4, wherein processing the selected audio feedback file package occurs in response to detecting a performance parameter of the user during the athletic activity.

12. The method of claim 4, wherein the selected audio feedback file package comprises a first audio feedback file and a second audio feedback file associated through an index source, and wherein generating the audio feedback phrase is based on the association of the first and second audio feedback files through the index source and the data array.

13. The method of claim 4, wherein the selected audio feedback file package comprises audio feedback files for supporting one of feedback related to the user's performance, course specific narration, workout specific audio guidance, feedback based on a distance travelled by the user during the athletic activity, and turn by turn directions.

14. The method of claim 4, wherein the selected audio feedback file package comprises a first audio feedback file including an audio feedback phrase in a first tone, and a second audio feedback file including the same audio feedback phrase in a second tone that differs from the first tone.

15. The method of claim 4, further comprising, the portable fitness monitoring device receiving a user input from the user to toggle between an off mode such that no audio feedback is provided, a free mode such that audio feedback is not automatically provided to the individual, and a coaching mode such that audio performance feedback is automatically provided to the user.

16. The method of claim 4, further comprising:

the portable fitness monitoring device providing a query to the user; and the portable fitness monitoring device initiating a workout routine based on the user's response to the query.

17. The method of claim 4, wherein the audible output is a predetermined output at a predetermined time.

18. The method of claim 4, wherein the audible output is provided to the user based on a trigger point during the athletic activity.

19. A method for providing audible output to a user during an athletic activity using a portable fitness monitoring device, comprising the steps of:

the portable fitness monitoring device receiving user input indicating a desired type of audio feedback;

the portable fitness monitoring device selecting an audio feedback file package based on the user input, and processing the selected audio feedback file package to provide audible output to the user during the athletic activity, wherein the processing comprises generating an audio feedback phrase; and the portable fitness monitoring device receiving a user input from the user to toggle between an off mode such that no audio feedback is provided, a free mode such that audio feedback is not automatically provided to the individual, and a coaching mode such that audio performance feedback is automatically provided to the user.

* * * * *